US008072294B2

(12) United States Patent
Tanpo et al.

(10) Patent No.: US 8,072,294 B2
(45) Date of Patent: Dec. 6, 2011

(54) FILTER HAVING SWITCH FUNCTION AND BAND PASS FILTER

(75) Inventors: Hiroshi Tanpo, Tokyo (JP); Tsuyoshi Hamada, Tokyo (JP)

(73) Assignees: NEC Corporation, Tokyo (JP); NEC Engineering, Ltd., Tokyo (JP)

( * ) Notice: Subject to any disclaimer, the term of this patent is extended or adjusted under 35 U.S.C. 154(b) by 182 days.

(21) Appl. No.: 12/328,841

(22) Filed: Dec. 5, 2008

(65) Prior Publication Data

US 2009/0153264 A1 Jun. 18, 2009

(30) Foreign Application Priority Data

Dec. 17, 2007 (JP) ..... 2007-324156

(51) Int. Cl.
*H01P 5/12* (2006.01)
*H01P 1/20* (2006.01)

(52) U.S. Cl. ..... 333/134; 333/135; 333/137; 333/207; 333/209

(58) Field of Classification Search ..... 333/126, 333/129, 132, 134, 202, 206, 207, 226, 224, 333/135, 137, 208, 209
See application file for complete search history.

(56) References Cited

U.S. PATENT DOCUMENTS

| | | | | |
|---|---|---|---|---|
| 4,050,040 | A | 9/1977 | Fincke et al. | |
| 6,025,764 | A | 2/2000 | Pelz et al. | |
| 6,359,529 | B1 * | 3/2002 | Tsunoda et al. | 333/101 |
| 6,426,682 | B1 | 7/2002 | Herzberg et al. | |
| 7,236,069 | B2 | 6/2007 | Puoskari | |
| 2005/0275488 | A1 | 12/2005 | Blair et al. | |

FOREIGN PATENT DOCUMENTS

| | | |
|---|---|---|
| EP | 0 851 526 | 7/1998 |
| JP | 10-242710 | 9/1998 |
| JP | 2000-174504 | 6/2000 |
| JP | 2005-051656 | 2/2005 |
| KR | 10-0266377 | 6/2000 |
| KR | 0266377 | 9/2000 |

OTHER PUBLICATIONS

European Patent Office issued an European Search Report dated Mar. 4, 2009, Application No. 08021398.6.
Japanese Patent Office issued a Japanese Office Action dated Dec. 2, 2009, Application No. 2007-324156.
Korean Patent Office issued a Korean Office Action dated May 24, 2010, Application No. 519980958731.
Korean Patent Office issued a Korean Office Action dated May 24, 2010, Application No. 10-2008-0127763.
European Office Action dated Mar. 2, 2011 in corresponding European Application No. 08021398.6.

* cited by examiner

*Primary Examiner* — Robert Pascal
*Assistant Examiner* — Kimberly Glenn
(74) *Attorney, Agent, or Firm* — Young & Thompson

(57) ABSTRACT

The filter has a switch function of selectively transmitting a transmission signal through one of first and second branch waveguides branching from a primary waveguide. The filter includes resonators disposed in the first and second branch waveguides. The resonator includes a space formed inside a metal cover, a central conductor disposed inside the space, and a short-circuiting plate. The central conductor has one end grounded to an outer conductor. The short-circuiting plate allows the neighborhood of an open end of the central conductor to be selectively conducted to the outer conductor. The filter performs a selection from the first and second branch waveguides by switching electrical conductivity in a region between the neighborhood of the open end of the central conductor and the outer conductor.

7 Claims, 25 Drawing Sheets

FILTER HAVING SWITCH FUNCTION AND BAND PASS FILTER

This application is based on Japanese patent application No. 2007-324156, the content of which is incorporated herein by reference.

BACKGROUND

1. Technical Field

The present invention relates to a filter having a switch function and a band pass filter, and more particularly, to a filter having a switch function suitable for a radio frequency (RF) communication device used in common for an antenna in a base station for a cellular phone adopting time division duplex scheme.

2. Related Art

Conventionally, a RF communication device used in common for an antenna by time division duplex scheme realizes transmission of baseband signals by switching between a transmission circuit and a reception circuit through time division using the same frequency band. In this kind of RF communication device, an RF switch circuit 74 having a construction of single pole double throw (SPDT) is installed between transmission/reception circuits (TX circuit 71 and RX circuit 72) and an RF filter circuit 73 as illustrated in FIG. 24, to perform switching a transmission path. Also, the RF switch circuit 74, for example, is configured by mounting an active device such as a PIN diode onto a microstrip line.

In a conventional RF communication device, respective circuits such as the transmission circuit 71 and the reception circuit 72 are formed as single elements, and they are connected with each other using a coaxial cable and the like. However, since the number of electrical and mechanistic components increases in this case, device costs may easily increase, and also, a transmission line of RF signals is lengthened, which increases a transmission loss of the circuit.

Japanese patent application publication No. 2005-51656 proposes a filter having a switch function that integrates an RF filter circuit and an RF switch circuit by installing PIN diodes D1*e* and D2*e* between an ANT terminal and an RX terminal, and between the ANT terminal and a TX terminal, respectively, as illustrated in FIG. 25. Also, in FIG. 25, C1*a* to C6*e* designate capacitance components and TL1*e* to TL4*e* designate short-circuit line resonators.

This filter circuit is configured to switch a conduction state between the ANT terminal and the RX terminal, and between the ANT terminal and the TX terminal by controlling voltages applied to the PIN diodes D1*e* and D2*e*, and thus to realize a switch operation. According to the same circuit, the number of components can be reduced and simultaneously, the length of the transmission line can be shortened, so that device cost reduction or transmission loss reduction can be achieved.

However, since the filter circuit has a construction of mounting a circuit device such as a chip condenser and a resonator on a plane circuit, that is, a plate-shaped dielectric substrate, and connecting the circuit device on a microstrip line, the transmission loss of the filter may be increased by the dielectric loss of the dielectric substrate. An increase in the transmission loss of the filter causes an increase of power consumption in a transmission circuit of a wireless device, and also, is directly connected with deterioration of a noise figure (NF) in a reception circuit. In that case, use of a low-loss substrate can be considered, but such a substrate is expensive. Also, when a low-cost substrate is used, selectivity of a material is not sufficient, so that it is difficult to obtain desired characteristics.

SUMMARY

In view of the foregoing, it is an object of the present invention to provide a filter having a switch function and a band pass filter which can obtain a low loss characteristic at low costs while making possible reduction in the number of components.

According to one aspect of the present invention, there is provided a filter having a switch function which comprises a waveguide structure having a plurality of resonators inside a metal case; and a plurality of branch waveguides branching from a primary waveguide, the filter selectively transmitting a transmission signal through one of the plurality of branch waveguides. Each resonator is disposed on the plurality of branch waveguides and includes: an inner conductor which is disposed in a space inside the metal case, one end of the inner conductor being grounded to the metal case; and a short-circuiting portion allowing a neighborhood of an open end of the inner conductor to be selectively conducted to the metal case. Electrical conductivity in a region between the neighborhood of the open end of the inner conductor and the metal case is switched between a conductive state and a non-conductive state, so that a selection from the plurality of branch waveguides is performed.

In the filter having the switch function, electrical conductivity in a region between the neighborhood of the open end of the inner conductor and the metal case are switched between a conductive state and a non-conductive state, so that the frequency characteristic of the branch waveguide can be changed, and a switch can be configured using the frequency characteristic. Accordingly, a switch construction and a filter construction can be integrated, so that the number of components or miniaturization of a device can be achieved. Also, since a resonator is not disposed on a plane circuit as in a conventional filter having a switch function, a low loss filter can also be realized.

In the filter having the switch function, the short-circuiting portion may be configured to include a short-circuiting plate constructed between the neighborhood of the open end of the inner conductor and the metal case, a short circuit line disposed on the short-circuiting plate to electrically connect the neighborhood of the open end of the inner conductor with the metal case, and an active device disposed on the short circuit line to switch, between a conductive state and a non-conductive state, electrical conductivity in a region between the neighborhood of the open end of the inner conductor and the metal case. According to this construction, a conduction state between the neighborhood of the open end of the inner conductor and the metal case may be easily switched, and simultaneously, a switch may be configured with a simple construction.

In the filter having the switch function, the short-circuiting plate may be integrally formed with a stacked print substrate installed between the metal case and a metal cover. According to this construction, only the short-circuiting plate does not need to be separately formed. Also, even when the short-circuiting plate is attached inside the metal case, an attaching process may be completed simultaneously with attachment of the stacked print substrate, so that the number of components or assembling manhours may be reduced.

In the filter having the switch function, a resonator may be disposed on at least one of the plurality of branch waveguides. The resonator includes: a space inside the metal case; an inner conductor which is disposed inside the space and whose one end is grounded to the metal case; a conductive plate disposed inside the space and installed outside an outer peripheral surface of the inner conductor; and a short-circuiting portion allowing the conductive plate to be selectively conducted to the metal case. Accordingly, a filter having an excellent power-withstanding property may be configured.

In the filter having the switch function, the conductive plate may be formed by attaching a conductive coated film on a surface of a dielectric plate integrally formed with the stacked print substrate, and the short-circuiting portion may allow the conductive coated film to be selectively conducted to the metal case. Accordingly, the number of components or assembling manhours may be reduced.

In the filter having the switch function, the conductive plate may be formed in a ring shape or a U-shape.

According to another aspect of the present invention, there is provided a band pass filter including a plurality of resonators inside a metal case, wherein at least one of the plurality of resonators includes: a space inside the metal case; an inner conductor which is disposed inside the space and whose one end is grounded to the metal case; and a short-circuiting portion allowing a neighborhood of an open end of the inner conductor to be selectively conducted to the metal case. The resonator changes a frequency characteristic by switching, between a conductive state and a non-conductive state, electrical conductivity in a region between the neighborhood of the open end of the inner conductor and the metal case.

As described above, it is possible to provide the filter having a switch function that can obtain a low loss characteristic at low costs while making possible reduction in the number of components.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION

The invention will be now described herein with reference to illustrative embodiments. Those skilled in the art will recognize that many alternative embodiments can be accomplished using the teachings of the present invention and that the invention is not limited to the embodiments illustrated for explanatory purposed.

Next, an embodiment of the present invention is described in detail with reference to accompanying drawings.

Figure 1:
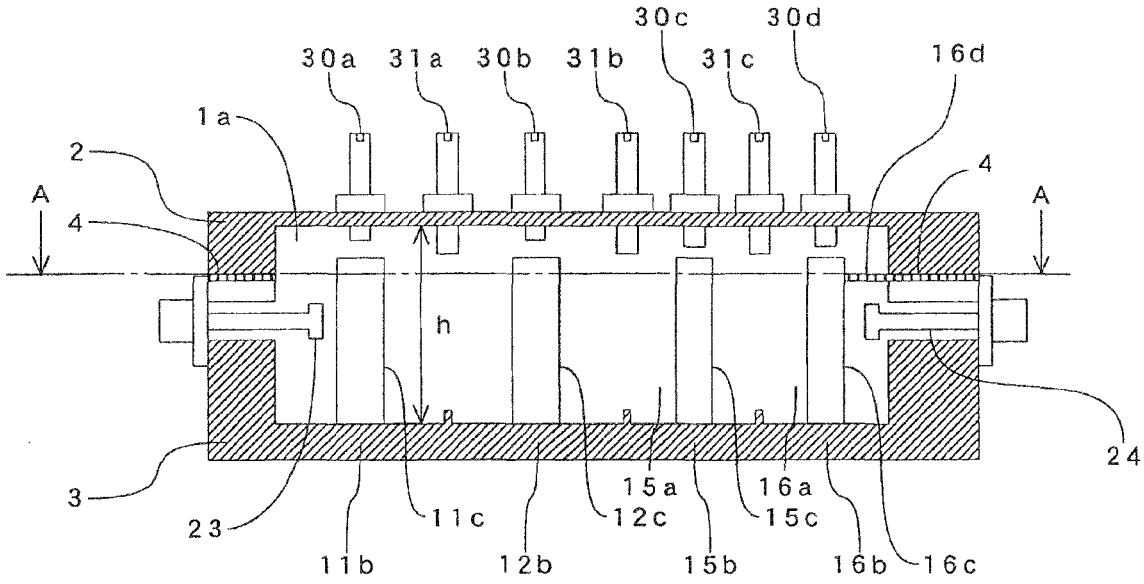
FIG. 1 is a side cross-sectional view illustrating a first embodiment of a filter having a switch function according to the present invention.
Figure 2A:
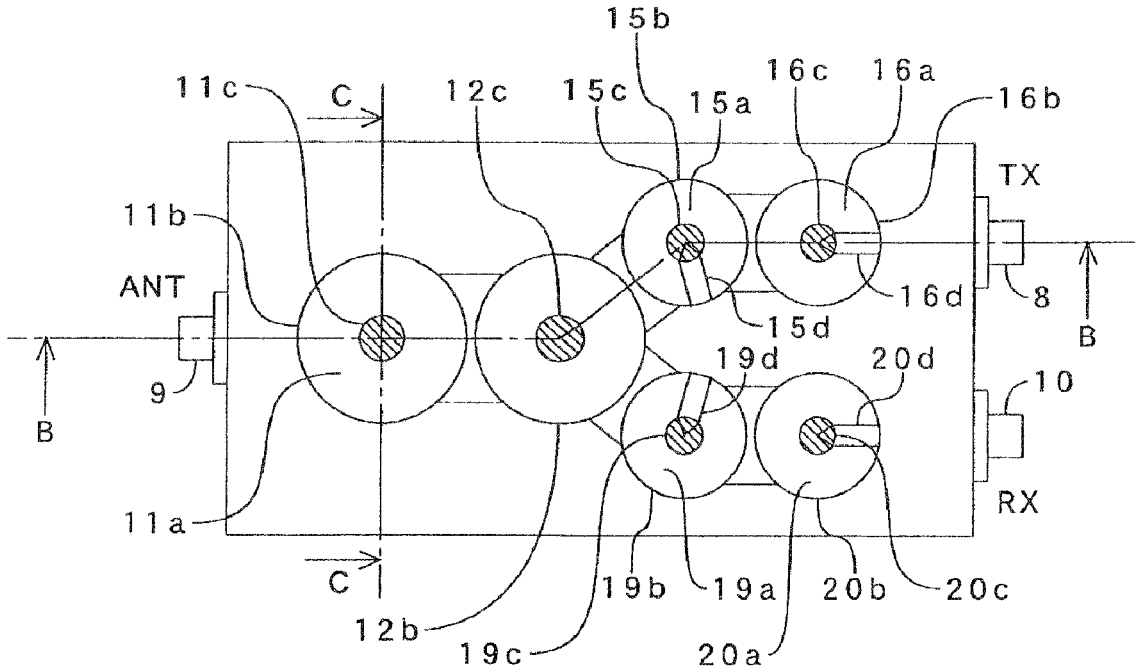
FIGS. 2A and 2B are a cross-sectional view taken along a line A-A of FIG. 1 and a view illustrating a transmission line, respectively.
Figure 2B:
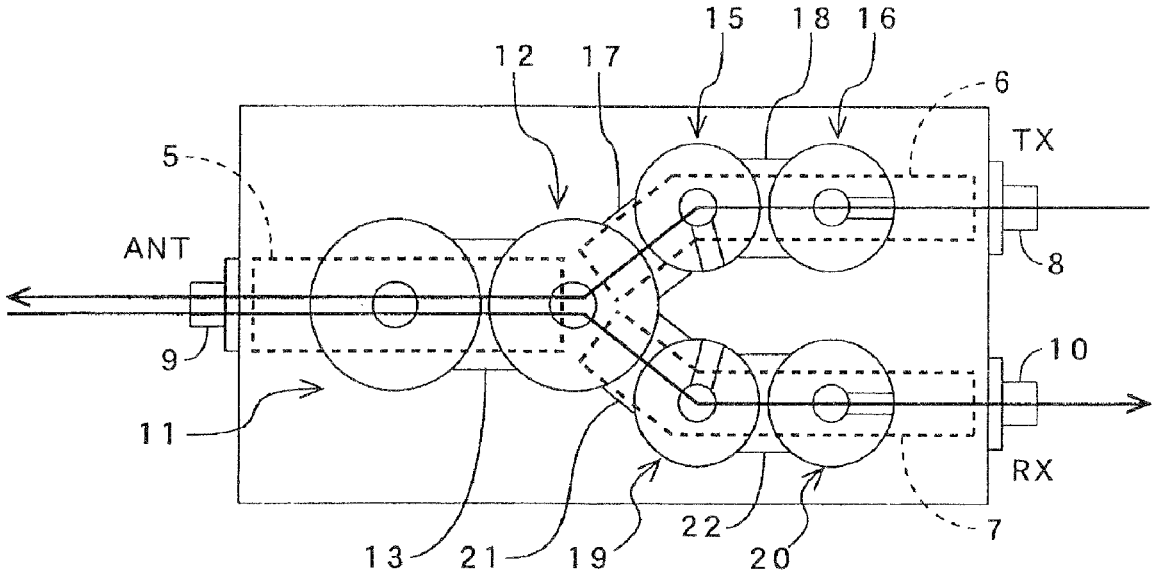
Figure 3:
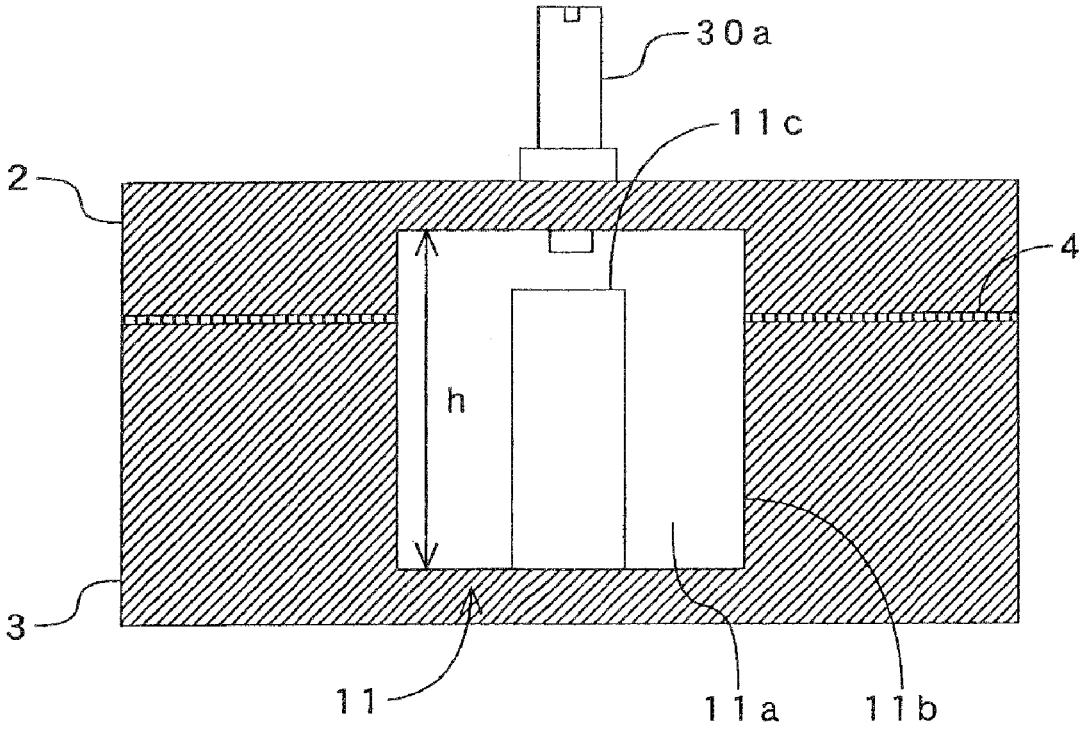
FIG. 3 is a cross-sectional view taken along a line C-C of FIGS. 2A and 2B.

FIGS. 1 to 3 are construction view illustrating a filter having a switch function according to a first embodiment of the present invention. Also, FIG. 1 is a cross-sectional view taken along a line B-B of FIGS. 2A and 2B, FIGS. 2A and 2B are cross-sectional views taken along a line A-A of FIG. 1, and FIG. 3 is a cross-sectional view taken along a line C-C of FIGS. 2A and 2B.

As illustrated in FIG. 1, a filter 1 having a switch function roughly includes a metal case 2, a metal cover 3 covered with the metal case 2, and a stacked print substrate 4 inserted between the metal case 2 and the metal cover 3. A space 1*a* having a height h equal to or less than a wavelength λ/4 of a use frequency and having a Y-shape (refer to FIG. 2A) as viewed from above is formed inside the metal case 2 and the metal cover 3. As illustrated in FIG. 2B, a primary waveguide 5, and first and second branch waveguides 6 and 7 branching from the primary waveguide 5 are formed.

The primary waveguide 5 is a transmission line through which both signals between a TX terminal 8 and an ANT terminal 9, and signals between the ANT terminal 9 and an RX terminal 10 are transmitted. Two resonators 11 and 12 and a slit 13 formed between them are disposed on the transmission line. Referring to FIGS. 2A and 3, the resonator 11 is a semi-coaxial resonator where a metal bar (central conductor) 11*c* having a shaft shorter than the height h is disposed at the central axis of a cylinder-shaped space 11*a*, and one end of the lengthwise direction of the central conductor 11*c* is grounded to an outer conductor (metal cover 3) 11*b*. Also, the resonator 12 is a semi-coaxial resonator, and includes an outer conductor 12*b* and a central conductor 12*c* as illustrated in FIG. 2A.

Referring back to FIG. 2B, the first branch waveguide 6 is a transmission line through which signals between the TX terminal 8 and the ANT terminal 9 are transmitted. Two resonators 15 and 16, a slit 17 formed between the resonator 12 and the resonator 15, and a slit 18 formed between the resonator 15 and the resonator 16 are disposed on the transmission line. Referring to FIG. 2A, the resonator 15 is a semi-coaxial resonator where a central conductor 15*c* is installed at the central axis of a cylinder-shaped space 15*a*. A short-circuiting plate 15*d* integrally formed with the stacked print substrate 4 (refer to FIG. 1) is constructed between the neighborhood of the open end of a central conductor 15*c* and an outer conductor 15*b*. Also, the resonator 16 has the same construction as the resonator 15, and includes a central conductor 16*c* disposed inside a cylinder-shaped space 16*a*, and a short-circuiting plate 16*d* constructed between the neighborhood of the open end of the central conductor 16*c* and an outer conductor 16*b*.

Referring back to FIG. 2B, the second branch waveguide 7 is a transmission line through which signals between the ANT terminal 9 and the RX terminal 10 are transmitted. Two resonators 19 and 20, a slit 21 formed between the resonator 12 and the resonator 19, and a slit 22 formed between the resonator 19 and the resonator 20 are disposed on the transmission line. Also, the resonators 19 and 20 are semi-coaxial resonators, and include central conductors 19*c* and 20*c* installed at the central axes of the cylinder-shaped spaces 19*a* and 20*a*, respectively, as illustrated in FIG. 2A. Also, as in the resonators 15 and 16 of the first branch waveguide 6, short-circuiting plates 19*d* and 20*d* integrally formed with the stacked print substrate 4 are constructed between the neighborhoods of the open ends of the central conductors 19*c* and 20*c* and outer conductors 19*b* and 20*b*.

In the above construction, coupling between respective resonators for a desired filter is determined depending on the widths or depth dimensions of the slits 13, 17, 18, 21, and 22 of FIG. 2B. Also, outside coupling of the filter input/output is determined depending on capacitance coupling of a coupling antenna 23 (or 24) and the central conductor 11*c* (or 12*c*) illustrated in FIG. 1. Also, the frequency response of a filter in a transmission side or a reception side is controlled and set to a desired characteristic using frequency control screws 30*a* to 30*d* and coupling control screws 31*a* to 31*c* controlling coupling between the resonators. The control screws 30*a* to 30*d*, and 31*a* to 31*c* are installed in the metal case 2.

Figure 4:
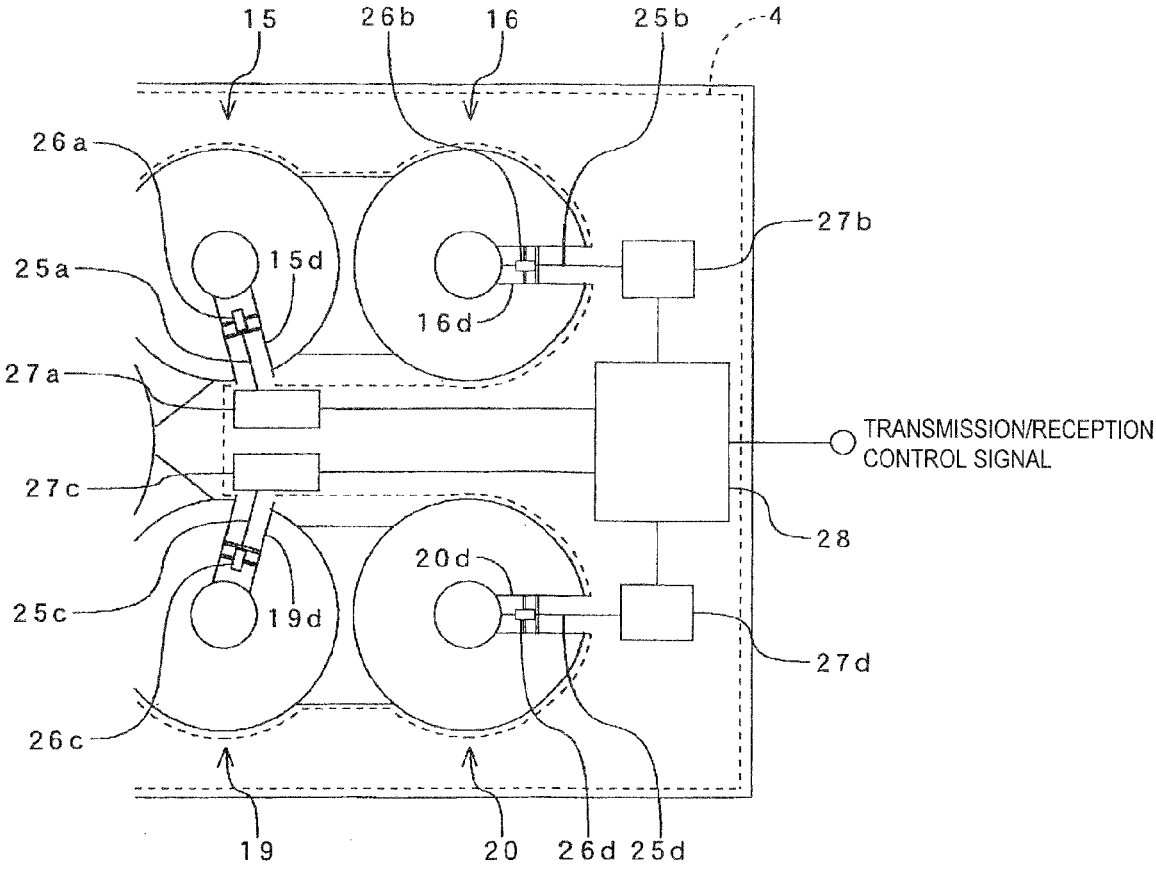
FIG. 4 is a top view illustrating the stacked print substrate of FIG. 1.

The stacked print substrate 4 illustrated in FIG. 1 is a dielectric substrate where various circuits are disposed. Referring to FIG. 4, regarding the resonators 15, 16, 19, and 20, bias lines 25*a* to 25*d* allowing electrical conduction between the central conductors 15*c* to 20*c* and the outer conductors 15*b* to 20*b* (refer to FIG. 2A), PIN diodes 26*a* to 26*d* as active devices connected on the bias lines 25*a* to 25*d*, bias circuits 27*a* to 27*d* applying a predetermined voltage to the PIN diodes 26*a* to 26*d*, and a voltage control circuit 28 are disposed on the substrate. The voltage control circuit 28 switch-controls the direction (forward direction or reverse direction) of a voltage applied to the PIN diodes 26*a* to 26*d* in response to a transmission/reception control signal.

Figure 5:
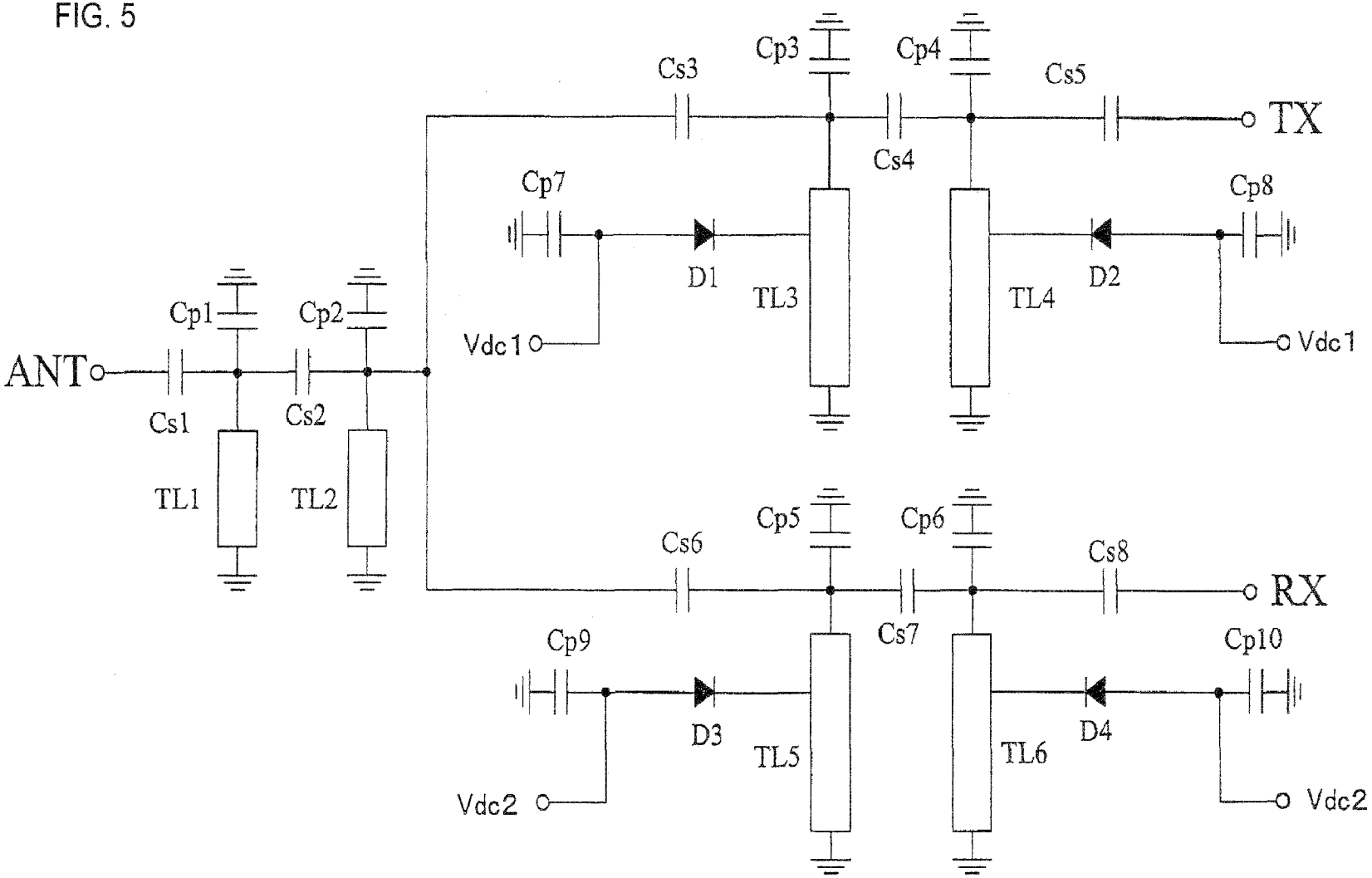
FIG. 5 is a view illustrating an exemplary equivalent circuit of the filter having the switch function of FIG. 1.

FIG. 5 illustrates an example of an equivalent circuit of the filter 1 having the switch function. Also, in FIG. 5, each of Cp1 to Cp6 is capacitance between the open end of the central conductor of the resonator, the metal case, and the control screw. Each of Cp7 to Cp10 is capacitance between the outer conductor of the resonator and a land of a component mounting unit. Also, each of Cs1, Cs5, and Cs8 is outside coupling capacitance of the filter, and each of Cs2 to Cs4, Cs6, and Cs7 is coupling capacitance between the resonators.

Next, the operation of the filter 1 having the switch function is described. In the filter 1 having the switch function, an application voltage to the PIN diodes 26*a* to 26*d* is switched between a forward voltage and a reverse voltage, so that the central frequencies of the resonators 15, 16, 19, and 20 disposed on the first and second branch waveguides 6 and 7 are changed, and accordingly, a path switching between the TX terminal 8 and the ANT terminal 9, and between the ANT terminal 9 and the RX terminal 10 is performed. In Table 1, an example of a switch control method is illustrated.

TABLE 1

| No. | LOGIC OF TRANSMISSION/ RECEPTION CONTROL SIGNAL | TX SWITCH | RX SWITCH | SIGNAL PATH | PIN DIODE AT TX SIDE | PIN DIODE AT RX SIDE |
|---|---|---|---|---|---|---|
| 1 | High | ON | OFF | TX-ANT | REVERSE VOLTAGE | FORWARD VOLTAGE |
| 2 | Low | OFF | ON | ANT-RX | FORWARD VOLTAGE | REVERSE VOLTAGE |

The frequency response of the filter for each path is set to a desired center frequency f0. However, in case of using a path between the TX terminal 8 and the ANT terminal 9, for example, a reverse voltage is applied to the PIN diodes 26*a* and 26*b*, and portions between the central conductors 15*c* and 16*c*, and the outer conductors 15*b* and 16*b* in the resonators 15 and 16 on the first branch waveguide 6 are set to a non-conductive state, so that the central frequencies of the resonators 15 and 16 are maintained at f0. Meanwhile, regarding the resonators 19 and 20 on the second branch waveguide 7, a forward voltage is applied to the PIN diodes 26*c* and 26*d*, and portions between the neighborhoods of the open ends of the central conductors 19*c* and 20*c*, and the outer conductors 19*b* and 20*b* are made electrically conductive, so that the central frequencies of the resonators 19 and 20 are changed into a frequency f1 excluding f0. At this point, it is preferable that input impedance when the resonator 12 on the primary waveguide 5 sees the resonators 19 and 20 of the second branch waveguide 7 is made infinite (Zin=∞) ideally. Also, indeed, in the resonator not selected, not only a center frequency thereof changes but also a loss by the forward resistance component of a PIN diode is generated, so that a no-load Q is deteriorated.

Figure 6A:
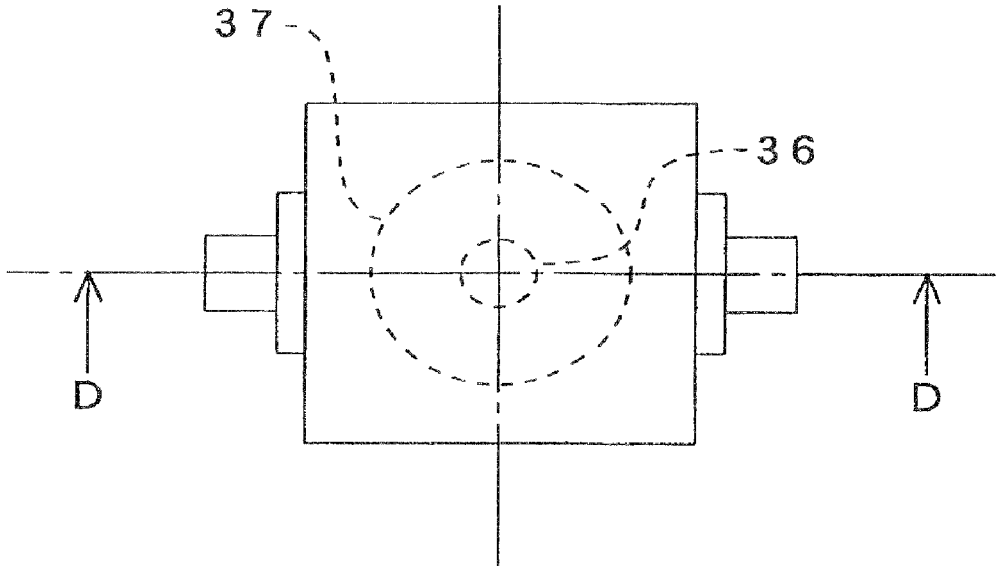
FIGS. 6A and 6B are a top view illustrating the basic structure of a resonator, and a cross-sectional view taken along a line D-D of FIG. 6A.
Figure 6B:
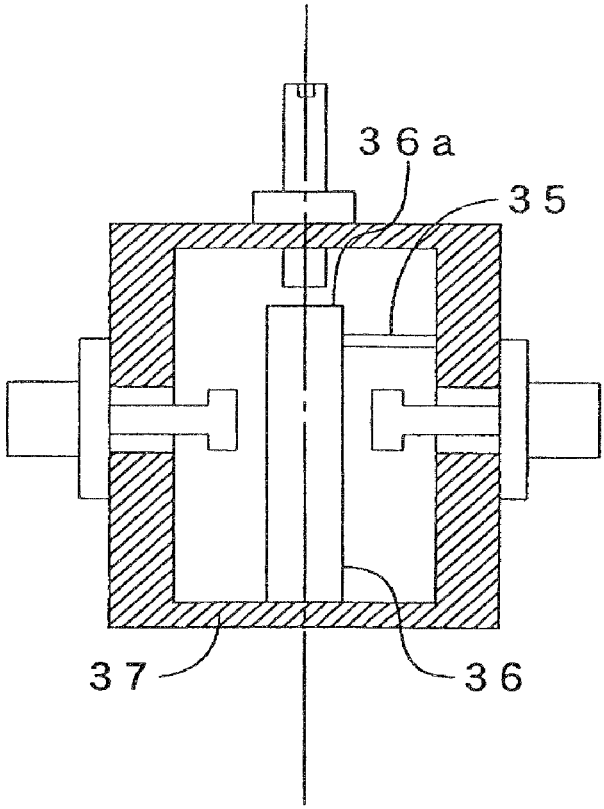
Figure 7:
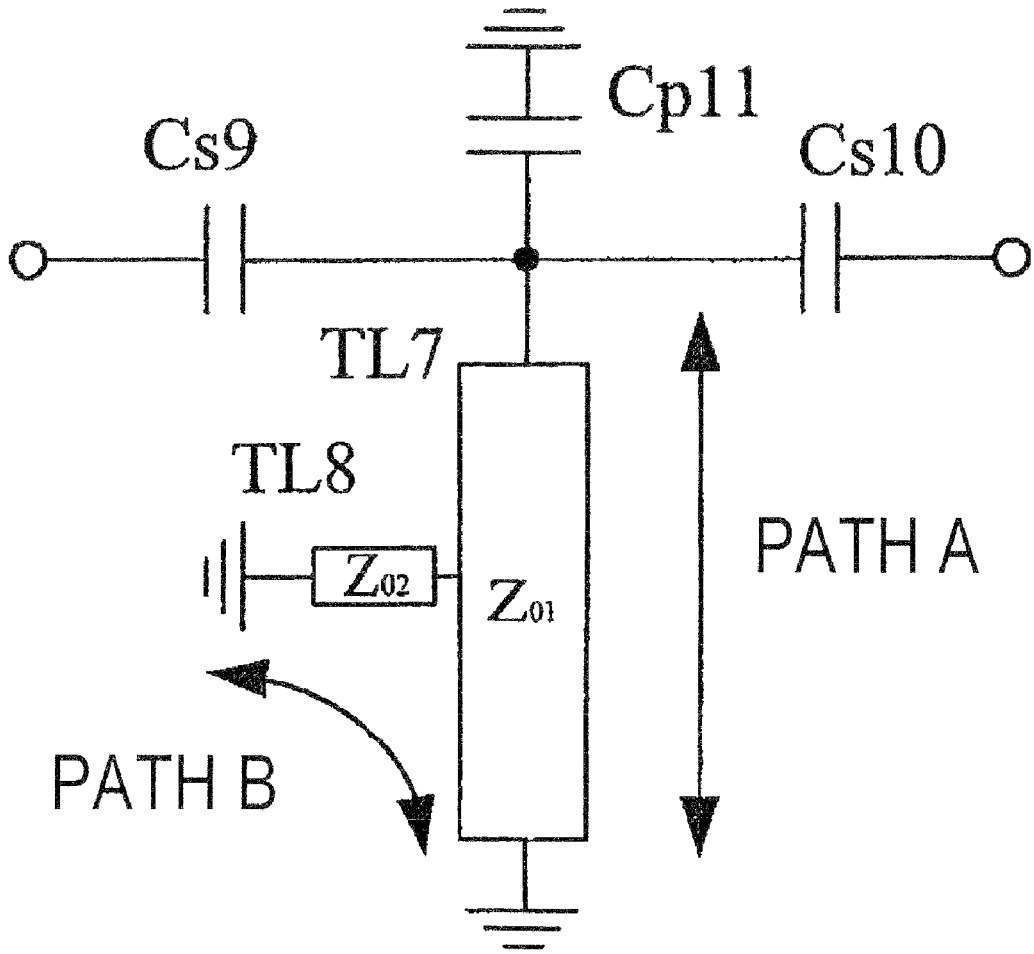
FIG. 7 is a view illustrating an exemplary equivalent circuit by a distribution constant of the resonator of FIGS. 6A and 6B.
Figure 8:
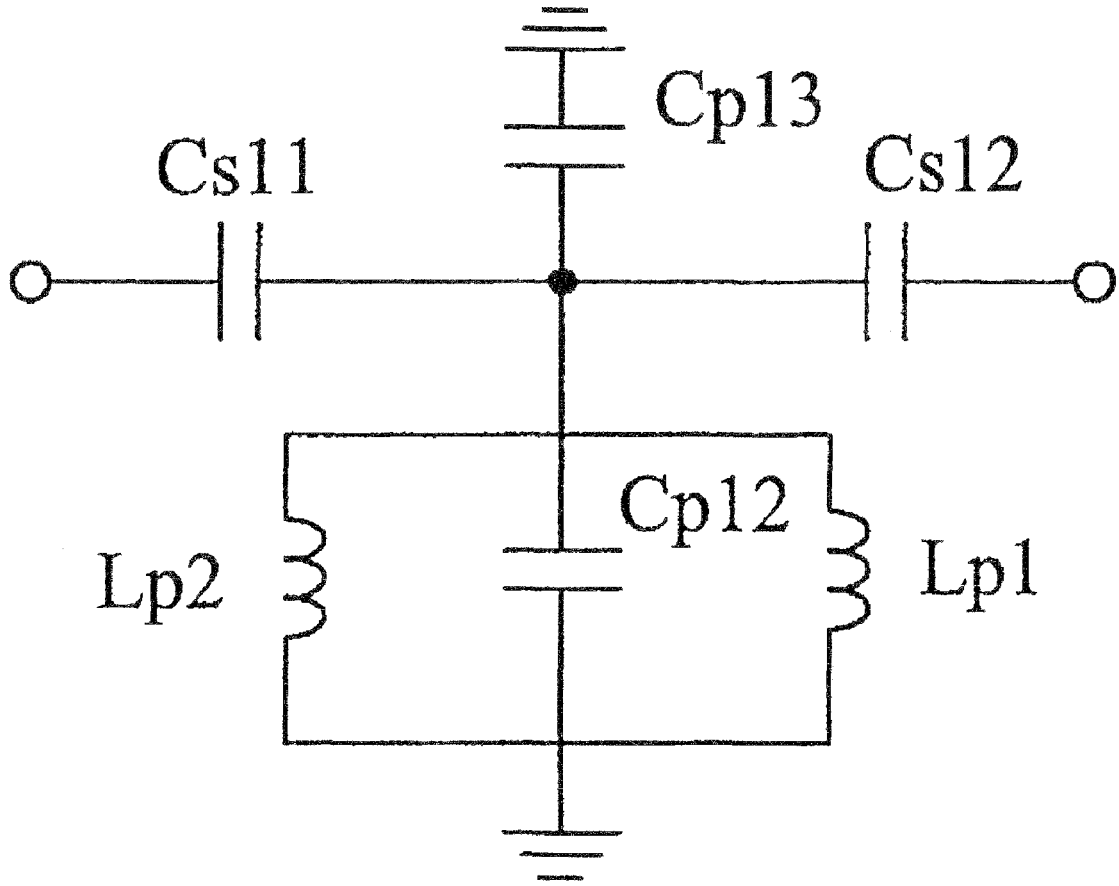
FIG. 8 is a view illustrating an exemplary equivalent circuit by a concentration constant of the resonator of FIGS. 6A and 6B.
Figure 9:
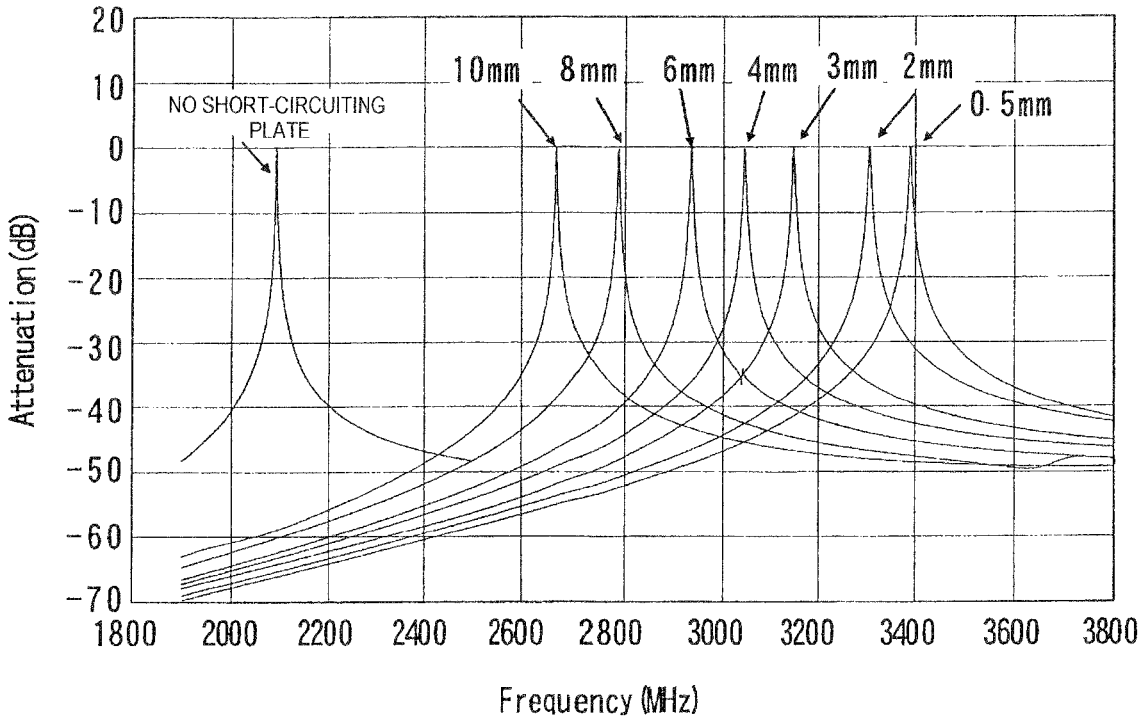
FIG. 9 is a view illustrating an example of a frequency characteristic when the position of a short-circuiting plate is changed.
Figure 10:
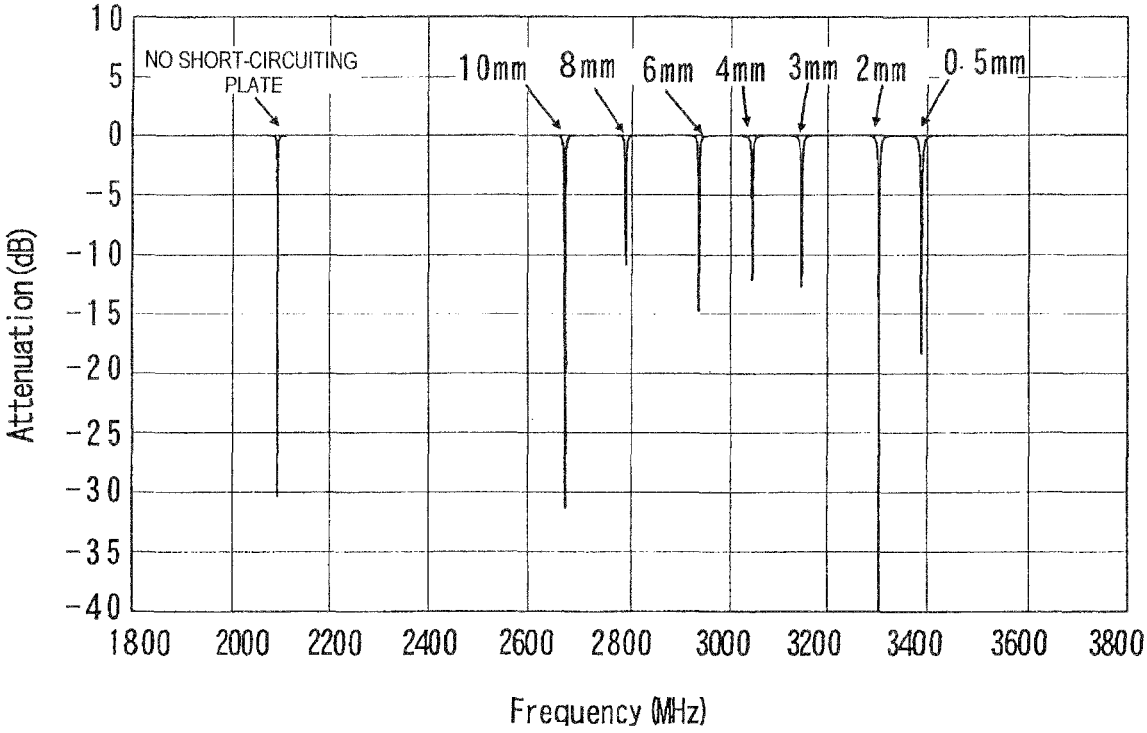
FIG. 10 is a view illustrating an example of a reflection characteristic when the position of a short-circuiting plate is changed.

Here, a principle of varying the frequency of a resonator is described with reference to FIGS. 6 to 10. FIGS. 6A and 6B are views illustrating a basic structure of a resonator. Also, FIGS. 7 and 8 are examples of equivalent circuits by a distribution constant and a concentration constant of the resonator of FIGS. 6A and 6B, respectively. Also, FIG. 9 is a view illustrating an example of a frequency characteristic when the positions of short-circuiting plates are sequentially changed at the open end of the central conductor, and FIG. 10 is a view illustrating an example of a reflection characteristic at that point. Also, here, it is assumed that the resonator has no loss for convenience in description.

In a resonator having the structure of FIGS. 6A and 6B, when a short-circuiting plate 35 is located in the neighborhood of an open end 36*a* of a central conductor 36, a resonance frequency changes to about 1.5 to 2 times greater frequency toward a high frequency compared to a characteristic of a case where the short-circuiting plate 35 is absent as illustrated in FIG. 9. The reason is that a semi-coaxial resonator generates resonance of a wavelength ¼λ at the open end 36*a* of the central conductor 36 and a short circuit end, but when the short-circuiting plate 35 is located in the neighborhood of the open end 36*a* of the central conductor 36, resonance is dominantly generated at a path B rather than a path A in FIG. 7, so that resonance of wavelength ½λ is generated.

Typically, the characteristic impedance of a semi-coaxial resonator has about 50 to 80 W, but the characteristic impedance of the short-circuiting plate 35 has a high value of several hundred W and has strong induction. Description is made using the equivalent circuit by the concentration constant of FIG. 8. In the construction of FIGS. 6A and 6B, the transmission line portion in the case where the short-circuiting plate 35 is not installed is represented as parallel resonance of parallel inductance Lp1 and parallel capacitance Cp12. On the other hand, in the case where the short-circuiting plate 35 short-circuits the central conductor 36 and the outer conductor 37, a component of parallel inductance Lp2 by the short-circuiting plate 35 is added to the parallel resonance, so that a resonance frequency changes. Also, at this point, since a change degree of the resonance frequency is different depending on the position of the short-circuiting plate 35, the frequency characteristic may be controlled by controlling the position of the short-circuiting plate 35.

In the above, when whether to detach the short-circuiting plate 35 grounded to the outer conductor 37 from the central conductor 36, or whether to short-circuit the outer conductor 37 and the central conductor 36 through the short-circuiting plate 35 are switched, and a resonance condition is set to the path A or B, a frequency can be varied. Also, switching between open or short-circuit of the central conductor 36 can be performed using the above-described PIN diodes 26*a* to 26*d* (refer to FIG. 4).

Figure 13:
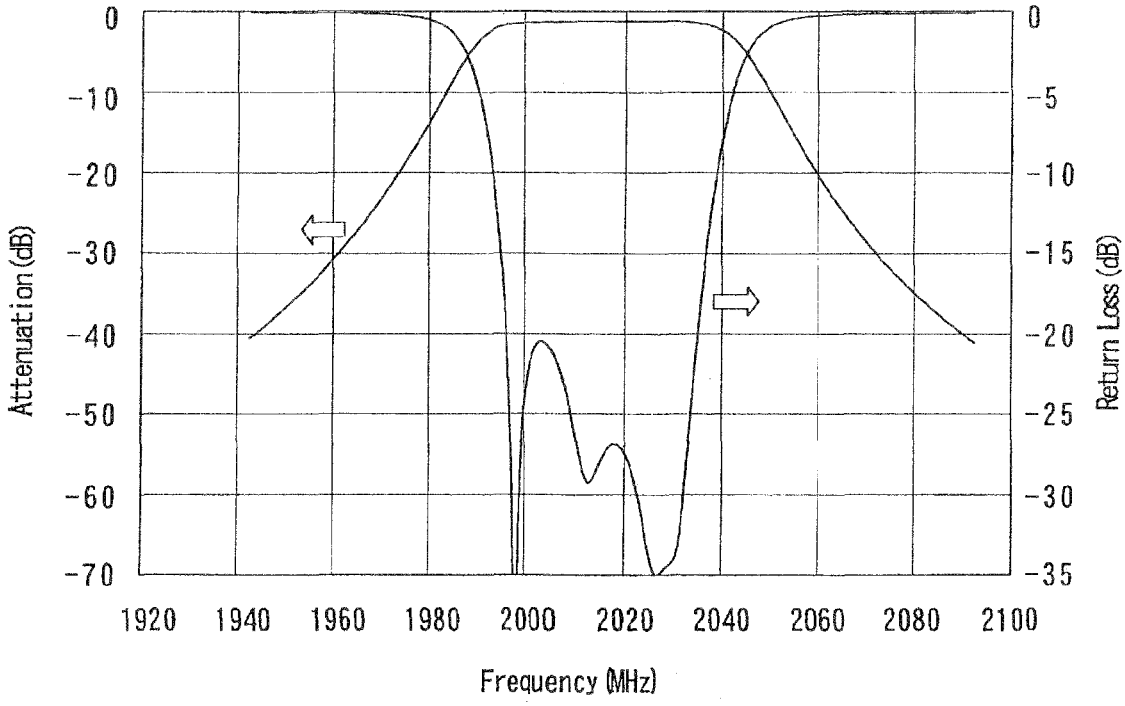
FIG. 13 is a view illustrating an example of a filter characteristic between an ANT terminal and an RX terminal when a path between these terminals is selected as a use transmission line.
Figure 14:
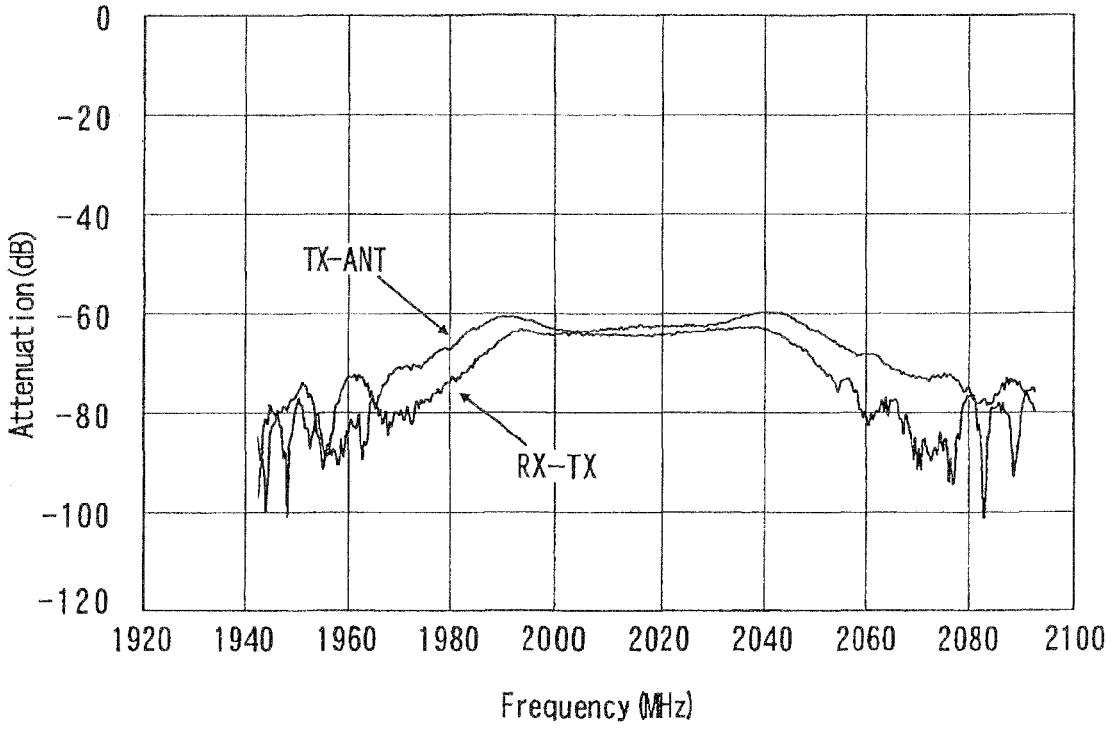
FIG. 14 is a view illustrating isolation characteristics between a TX terminal and an ANT terminal, and between an RX terminal and a TX terminal when a path between the ANT terminal and the RX terminal is selected as a use transmission line.

In the filter 1 having the switch function of FIGS. 1 to 5, FIG. 11 illustrates an example of a filter characteristic between the TX terminal 8 and the ANT terminal 9 in the case where a path between the terminals 8 and 9 is selected as a use transmission line. FIG. 12 illustrates an example of an isolation characteristic between the ANT terminal 9 and the RX terminal 10, and between the TX terminal 8 and the RX terminal 10 for the case of FIG. 11. Also, FIG. 13 illustrates an example of a filter characteristic between the ANT terminal 9 and the RX terminal 10 in the case where a path between the terminals 9 and 10 is selected as a use transmission line. FIG. 14 illustrates an example of an isolation characteristic between the TX terminal 8 and the ANT terminal 9, and between the RX terminal 10 and the TX terminal 8 for the case of FIG. 13.

Figure 11:
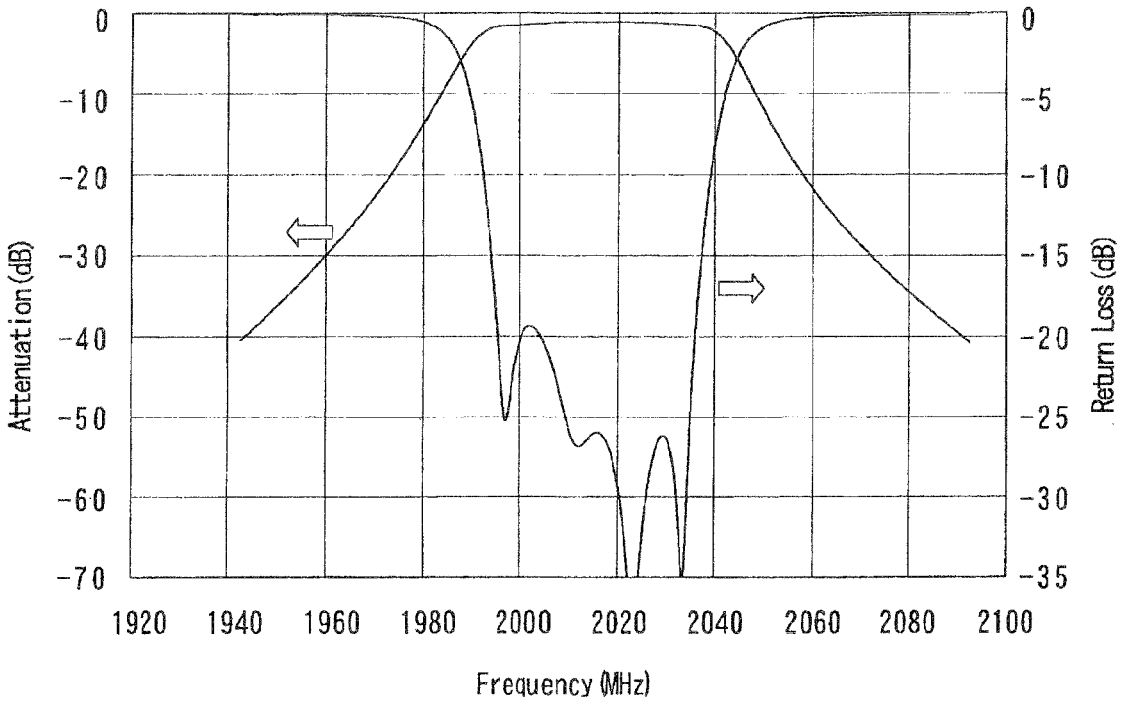
FIG. 11 is a view illustrating an example of a filter characteristic between a TX terminal and an ANT terminal when a path between these terminals is selected as a use transmission line.
Figure 12:
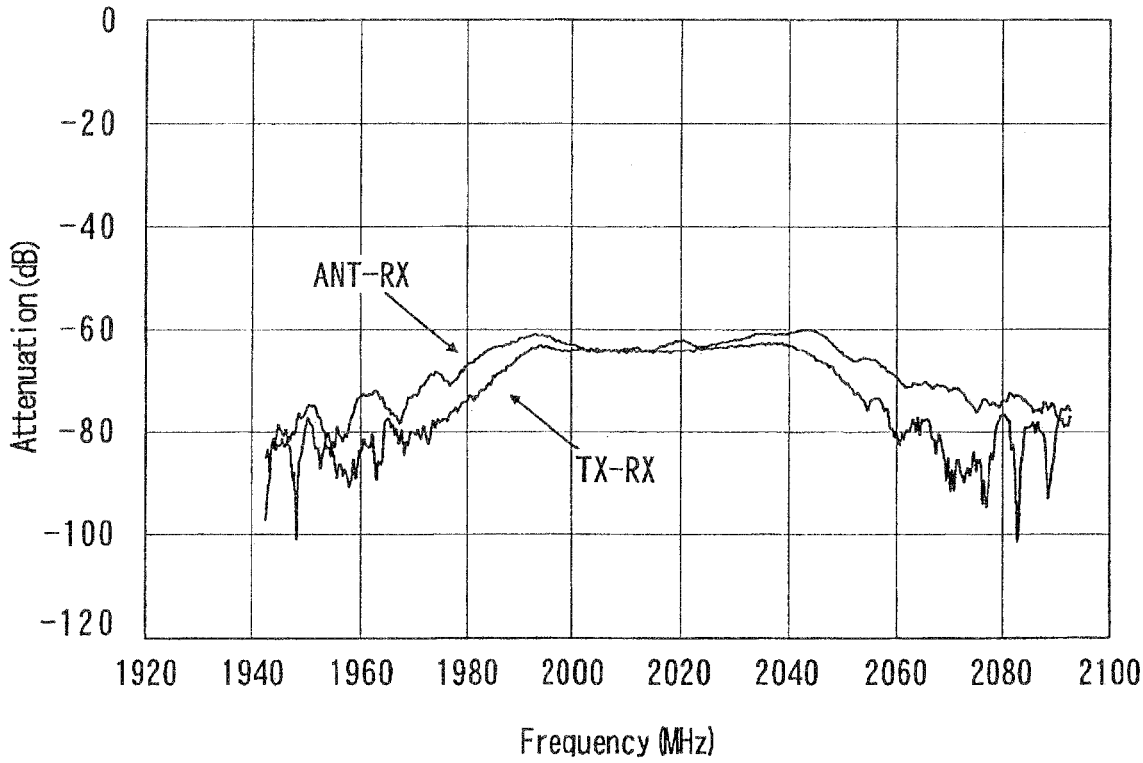
FIG. 12 is a view illustrating an example of isolation characteristics between an ANT terminal and an RX terminal, and between a TX terminal and the RX terminal when a path between the TX terminal and the ANT terminal is selected as a use transmission line.

As known from FIGS. 11 and 12, when the path between the TX terminal 8 and the ANT terminal 9 is selected as a use transmission line, a desired filter characteristic passing signals in the neighborhood of 2.0 to 2.4 GHz between the terminals 8 and 9 can be obtained. Meanwhile, an amount of isolation reduction is increased between the ANT terminal 9 and the RX terminal 10 of a non-use transmission line, so that transmission signals can be blocked. Also, as known from FIGS. 13 and 14, even when the path between the ANT terminal 9 and the RX terminal 10 is selected as a use transmission line, a desired filter characteristic can be obtained between the ANT terminal 9 and the RX terminal 10, and transmission signals can be blocked between the TX terminal 8 and the ANT terminal 9. Also, it is known from FIGS. 11 to 14 that in the filter 1 having the switch function illustrated in FIGS. 1 to 5, a transmission line structure is symmetric between the TX terminal 8 and the ANT terminal 9, and between the ANT terminal 9 and the RX terminal 10, so that the insertion losses or attenuation amounts except a relevant band of both paths properly coincide with each other.

As described above, according to the present embodiment, the short-circuiting plate connecting the open end of the central conductor with the outer conductor is installed in the resonator disposed in the branch waveguide, and the neighborhood of the open end of the central conductor of the resonator disposed in the transmission line not used is then made conducted with the outer conductor, so that the frequency characteristic of the transmission line is changed to block transmission signals. On the other hand, in the transmission line of a use side, a path between the neighborhood of the open end of the central conductor and the outer conductor of the resonator is set to a nonconductive state, so that the transmission line is allowed to serve as a band pass filter without changing a frequency characteristic. Therefore, a conduction state between the neighborhood of the open end of the central conductor and the outer conductor is switched, so that a switch operation (transmission line selection operation) can be realized. Therefore, a switch construction and a filter construction can be integrated, so that reduction in the number of components or miniaturization of a device can be achieved. Also, since a resonator is not disposed on a plane circuit as in a conventional filter having a switch function, a low-loss filter may be realized.

Also, though four PIN diodes are used in series for each resonator of a switch unit in the above embodiment, the number of PIN diodes to be used can be properly changed for the purpose of obtaining desired insertion loss and isolation value. For example, when PIN diodes are increased in series, a forward resistance component increases at the PIN diode to which a reverse voltage is applied. Accordingly, such increased PIN diodes form a circuit construction where a parallel resistor is added to the parallel inductance Lp1 and the parallel capacitance Cp12 of FIG. 8 in terms of an equivalent circuit by a concentration constant. In this case, since a no-load Q of a resonator increases when a forward resistance component increases, an insertion loss can be reduced. Meanwhile, an isolation characteristic is deteriorated.

Figure 15A:
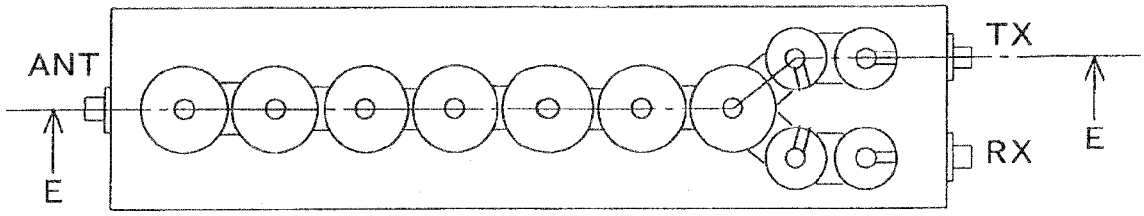
FIGS. 15A and 15B are a cross-sectional view taken along a line F-F of FIG. 15B, and a cross-sectional view taken along a line E-E of FIG. 15A, respectively, in a modification of the filter having the switch function illustrated in FIG. 1.
Figure 15B:
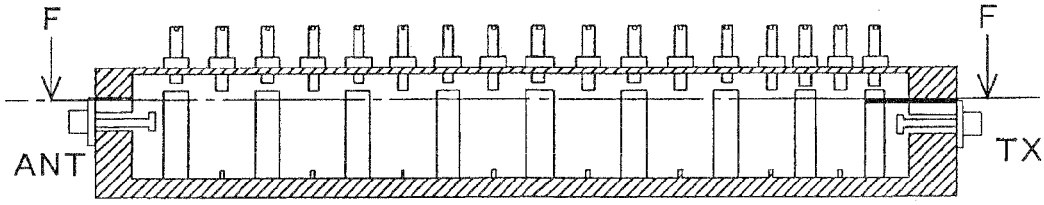
Figure 16:
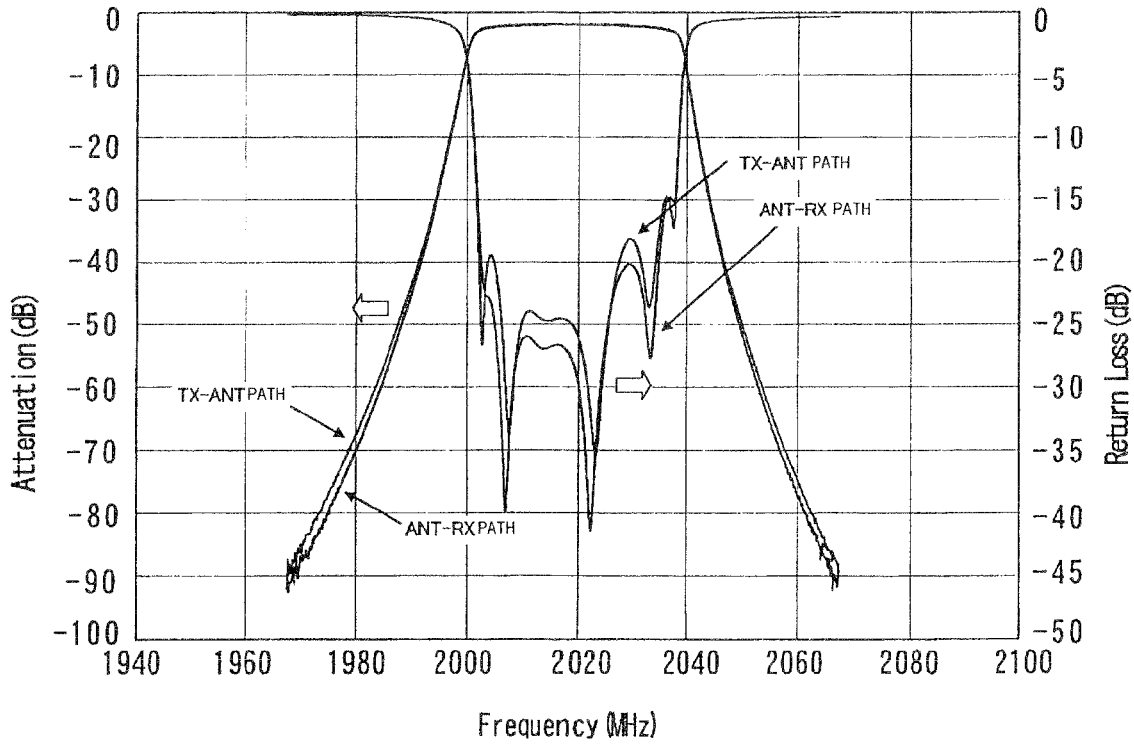
FIG. 16 is a view illustrating an exemplary frequency characteristic of the filter having the switch function of FIGS. 15A and 15B.
Figure 17:
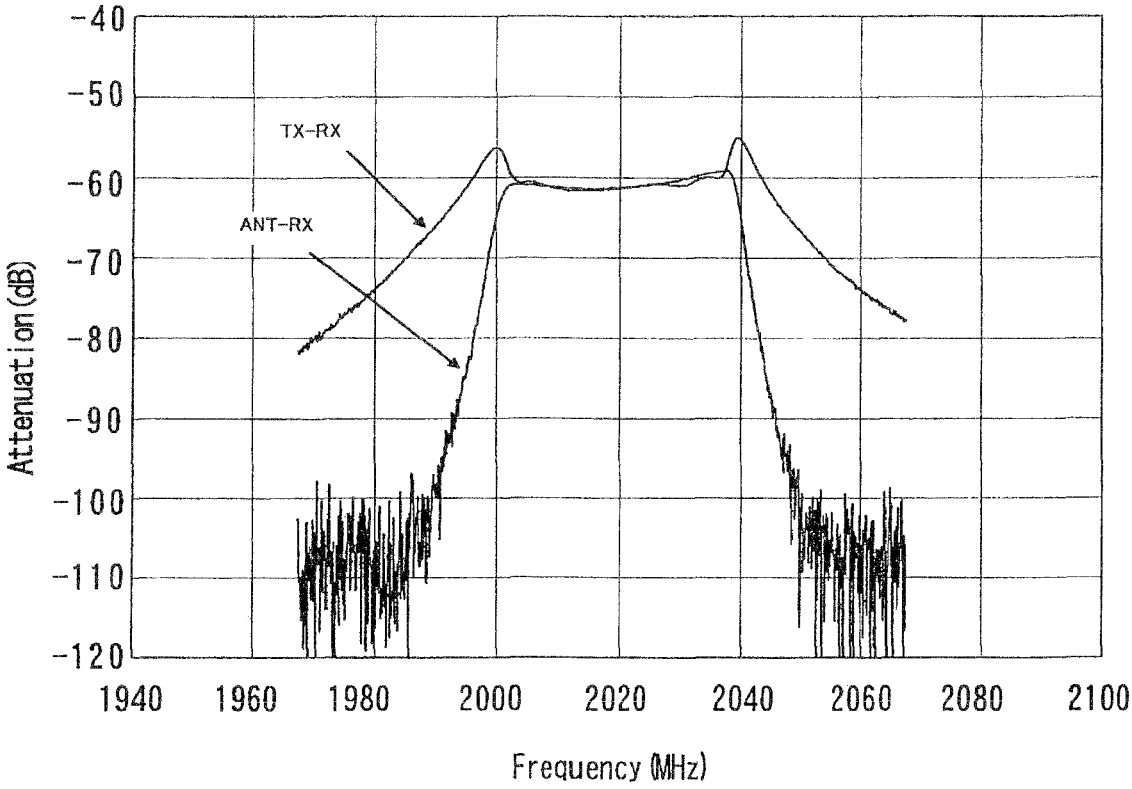
FIG. 17 is a view illustrating an exemplary isolation characteristic of the filter having the switch function of FIGS. 15A and 15B.

Also, though the number of stages of the resonators is four in the above embodiment, the resonators can be arranged otherwise. FIGS. 15A and 15B illustrate an example where the number of stages of the resonators is nine. Also, FIG. 16 illustrates a frequency characteristic of a case where a switch between the TX terminal and the ANT terminal or between the ANT terminal and the RX terminal is turned on. FIG. 17 illustrates isolation characteristics between the ANT terminal and the RX terminal, and between the TX terminal and the RX terminal for a case where a switch between the TX terminal and the ANT terminal is turned on.

As known from FIG. 16, since a no-load Q of a resonator mounting a switch therein is low, an insertion loss tends to deteriorate in a band end of a filter, but has a good characteristic in the neighborhood of a center frequency. Also, as known from FIG. 17, the same values as those in FIGS. 1 to 14 are obtained for the inside of a band. From the foregoing, the present embodiment can be effective even for a multi-stage filter.

Next, a second embodiment of the filter having the switch function according to the present invention is described with reference to FIGS. 18 to 21.

Since an electric field has a maximum value in the neighborhood of the open end of the central conductor, but the PIN diodes on the substrate are grounded from the outer conductor to the central conductor in an RF manner in the filter 1 having the switch function illustrated in FIGS. 1 to 14, a potential difference of an RF between both ends of the PIN diode increases. For this reason, when an RF signal of 1 W or more is transmitted from a transmission side to the filter, the RF signal exceeds the rated power of the PIN diode, so that there is possibility that transmittable power may be limited.

Figure 18B:
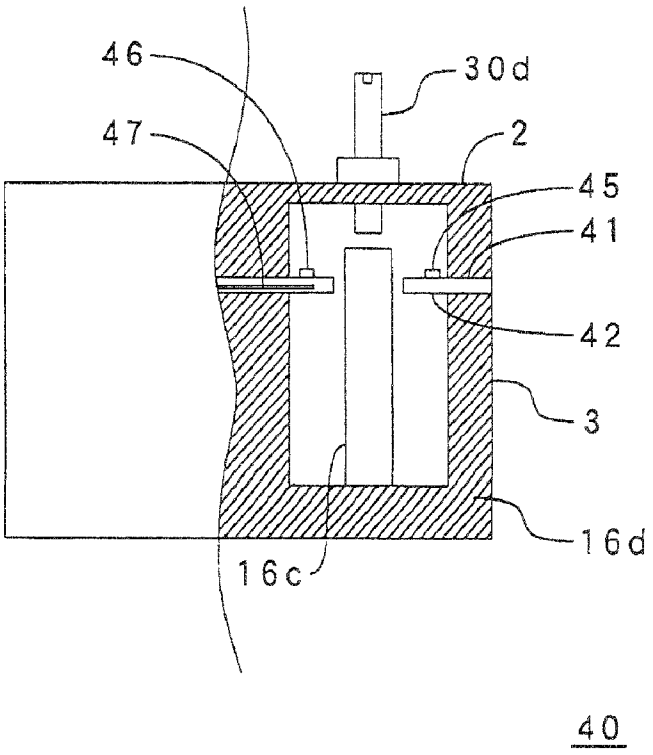
FIGS. 18A and 18B are a top view illustrating a second embodiment of a filter having a switch function according to the present invention, and a cross-sectional view taken along a line G-G of FIG. 18A, respectively.
Figure 18A:
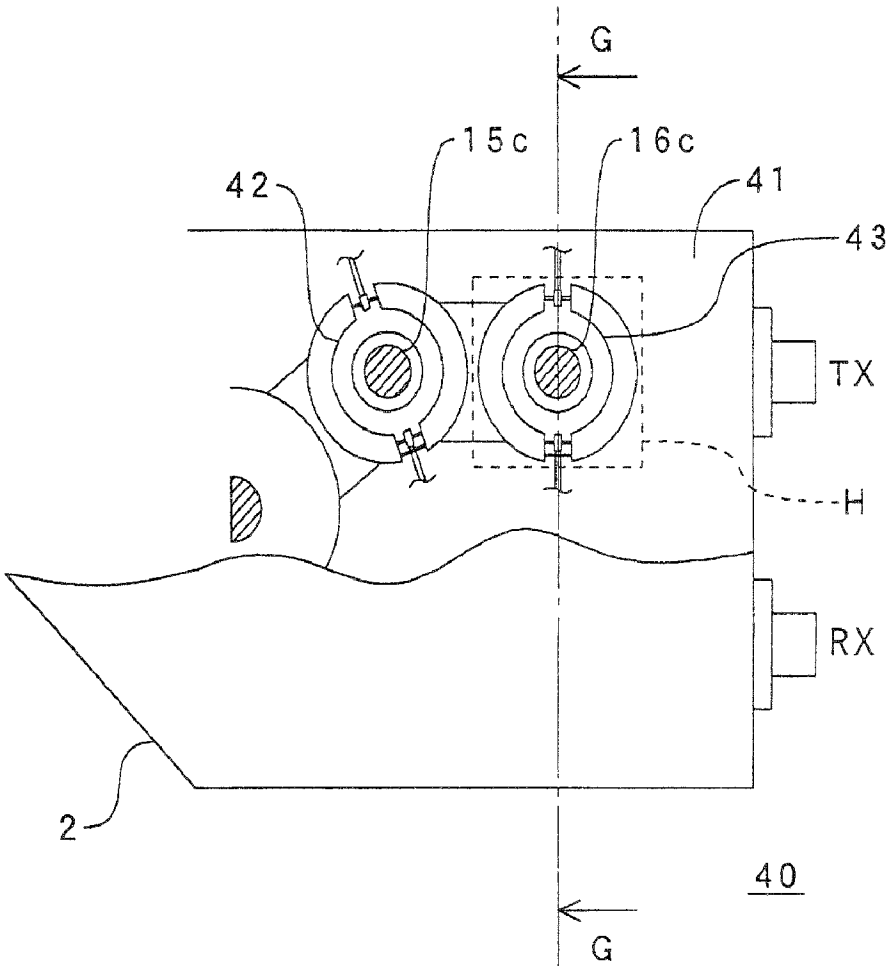
Figure 19:
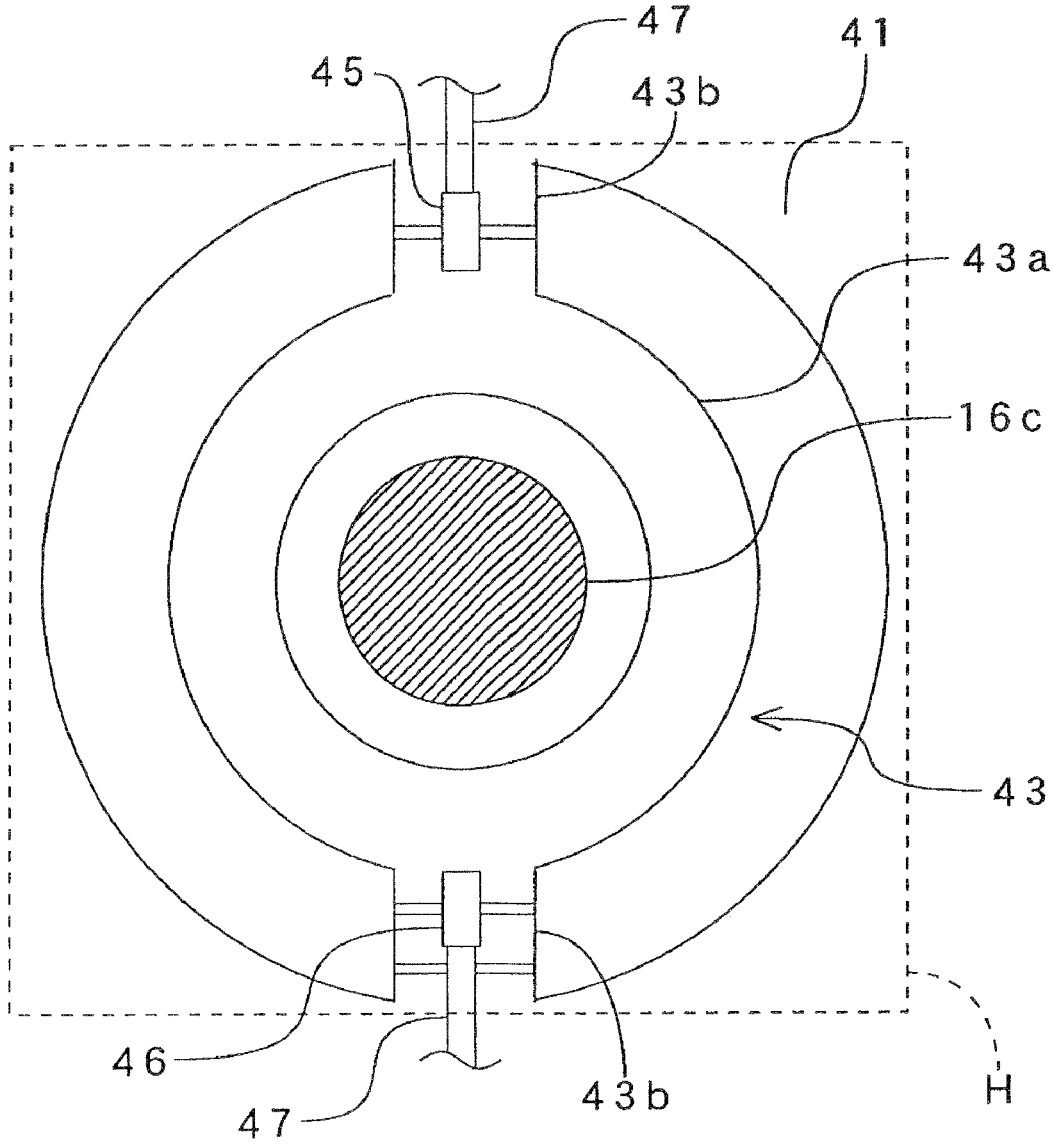
FIG. 19 is an enlarged view illustrating the region H of FIG. 18A.

The filter having the switch function according to an embodiment has improved power-withstanding property of a transmission side, and is illustrated in FIGS. 18 and 19. Also, FIG. 18B is a cross-sectional view taken along a line G-G of FIG. 18A, and FIG. 19 is an enlarged view of the region H of FIG. 18A. Also, in the drawings, the same reference numerals are used for the same elements as those illustrated in FIGS. 1 to 14.

Referring to FIG. 18A, a filter 40 having a switch function is different from the filter 1 having the switch function according to the first embodiment in that the filter 40 has ring-shaped substrates 42 and 43 instead of the short-circuiting plates 15*d* and 16*d* of FIGS. 2A and 2B in the resonator of the first branch waveguide (refer to FIG. 2B). Also, the structure of the resonator of the second branch waveguide side (refer to FIG. 2B) is the same as that illustrated in FIGS. 1 to 14.

The ring-shaped substrate 43 is integrally formed with the stacked print substrate 41. A copper foil is attached on the inner and outer surfaces of the substrate, and a plating process such as gold plating is performed on the lateral side. Referring to FIG. 19, the ring-shaped substrate 43 includes a ring-shaped substrate main body 43*a* disposed to surround the outer periphery of a central conductor 16*c* with a predetermined interval from the central conductor 16*c*, and two short-circuiting portions 43*b* connecting the ring-shaped substrate main body 43*a* to the stacked print substrate 41. PIN diodes 45 and 46, and a bias line 47 are disposed in the short-circuiting portion 43*b*. The PIN diodes 45 and 46 are disposed such that they have a forward direction with respect to a direction from the bias line 47 to the outer conductor 16*b* (refer to FIG. 18B). Also, though detailed description is not repeated, the ring-shaped substrate 42 also has the same construction as that of the ring-shaped substrate 43.

Figure 20:
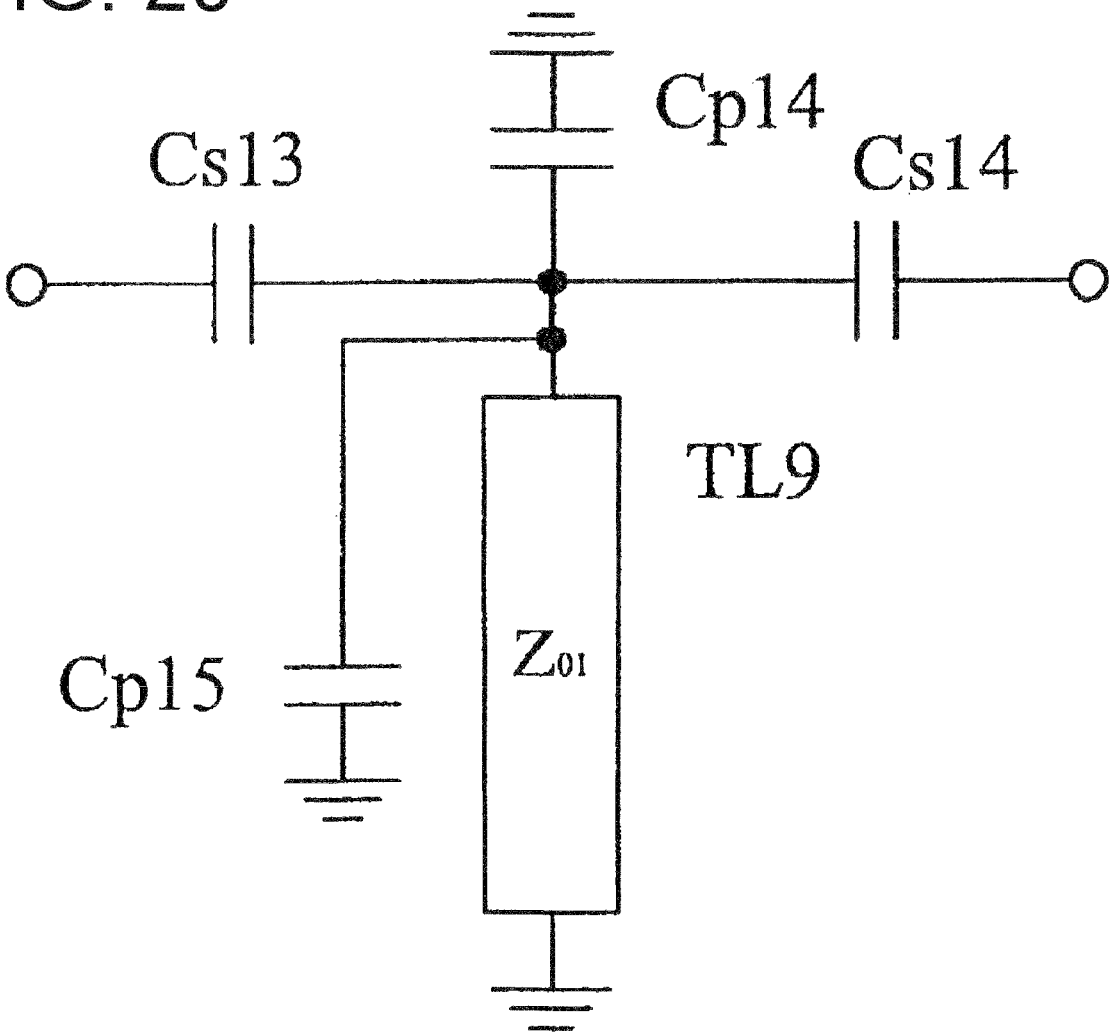
FIG. 20 is a view illustrating an exemplary equivalent circuit by a distribution constant of the resonator of FIGS. 18A and 18B.

Here, an operating principle of the resonator having the above construction is described with reference to an equivalent circuit example by the distribution constant of FIG. 20. Also, in FIG. 20, a coaxial resonator is represented by a transmission line TL9 of one short circuit, capacitance between an open end of the central conductor 16*c* of the resonator, a metal case 2, and a control screw 30*d* (refer to FIG. 18B) is Cp14, and capacitance between the outer peripheral surface of the central conductor 16*c* and the ring-shaped substrate 43 is Cp15.

When a forward voltage is applied to the PIN diodes 45 and 46, the copper foils on the ring-shaped substrate 43 and the outer conductor 16*b* are made conductive, so that the capacitance Cp15 is formed between the outer peripheral surface of the central conductor 16*c* and the ring-shaped substrate 43. This is equivalent to inserting a control screw in a direction from the sidewall of the outer conductor 16*b* to the central conductor 16*c*. Meanwhile, when a reverse voltage is applied to the PIN diodes 45 and 46, the ring-shaped substrate 43 is electrically separated from the central conductor 16*c* and the outer conductor 16*b*. In this case, since the capacitance Cp15 between the central conductor 16*c* and the ring-shaped substrate 43 reduces compared with a case where a forward voltage is applied to the PIN diodes 45 and 46, the center frequency of the resonator changes to a high frequency region.

As described above, since the center frequency changes when a reverse voltage is applied to the PIN diodes 45 and 46 in the resonator according to the embodiment, a switch operation is realized using this characteristic. Table 2 illustrates an example of a method of switch-controlling a path.

TABLE 2

| No. | LOGIC OF TRANSMISSION/ RECEPTION CONTROL SIGNAL | TX SWITCH | RX SWITCH | SIGNAL PATH | PIN DIODE AT TX SIDE | PIN DIODE AT RX SIDE |
|---|---|---|---|---|---|---|
| 1 | High | ON | OFF | TX-ANT | FORWARD VOLTAGE | FORWARD VOLTAGE |
| 2 | Low | OFF | ON | ANT-RX | REVERSE VOLTAGE | REVERSE VOLTAGE |

Referring to Table 2, when the switch between the TX terminal and the ANT terminal is turned on (when a path between the TX terminal and the ANT terminal is selected as a use transmission line), a forward voltage is applied to the PIN diodes 45 and 46 of the resonator on the first branch waveguide (branch waveguide between the TX terminal and the ANT terminal), and a forward voltage is also applied to the PIN diodes 26*c* and 26*d* (refer to FIG. 4) of the resonator on the second branch waveguide (branch waveguide between the ANT terminal and the RX terminal). Meanwhile, when the switch between the ANT terminal and the RX terminal is turned on (when a path between the ANT terminal and the RX terminal is selected as a use transmission line), a reverse voltage is applied to both the PIN diodes 45 and 46 of the resonator on the first branch waveguide (branch waveguide between the TX terminal and the ANT terminal), and the PIN diodes 26*c* and 26*d* of the resonator on the second branch waveguide (branch waveguide between the ANT terminal and the RX terminal).

Figure 21:
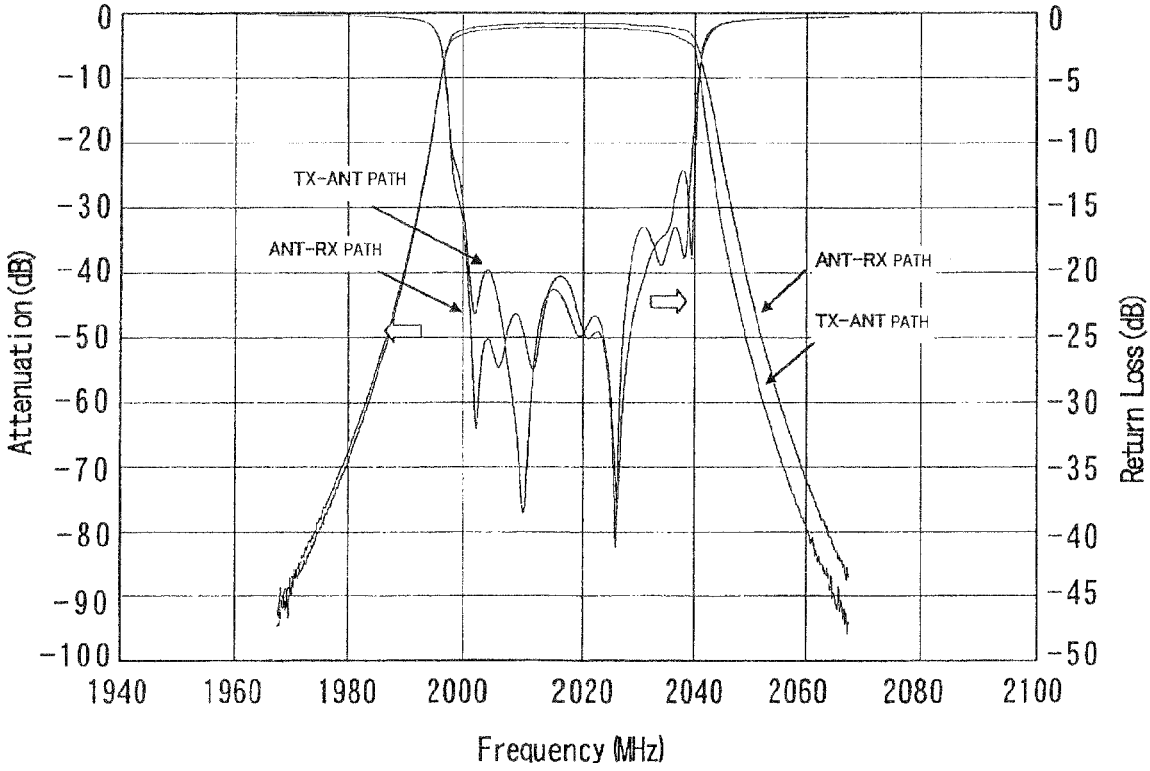
FIG. 21 is a view illustrating an exemplary frequency characteristic of the filter having the switch function illustrated in FIGS. 18A and 18B.

FIG. 21 illustrates a filter characteristic between the TX terminal and the ANT terminal when a path between the same terminals is selected as a use transmission line, and a filter characteristic between the ANT terminal and the RX terminal when a path between the same terminals is selected as a use transmission line in the filter 40 having the switch function.

As known from FIG. 21, like the case illustrated in FIGS. 11, 13, and 16, the present embodiment also obtains a desired band pass characteristic with respect to a path between the TX terminal and the ANT terminal, or a path between the ANT terminal and the RX terminal. Also, it is confirmed that the present embodiment can obtain values of the same degree as those of the characteristic example illustrated in FIG. 17 with respect to isolations between the ANT terminal and the RX terminal, and between the TX terminal and the RX terminal when the switch between the TX terminal and the ANT terminal is turned on.

Meanwhile, isolations between the TX terminal and the ANT terminal and between the RX terminal and the TX terminal when the switch between the ANT terminal and the RX terminal is turned on, reduce to about 30 dB. This is because an amount of frequency deviation between the TX terminal and the ANT terminal by a switch operation is small compared to the case illustrated in FIGS. 1 to 17, and impedance when the resonator branching to the transmission/reception side sees the TX terminal does not meet an open condition, and so an amount of RF signals leaking into the TX terminal increases. However, since an insertion loss between the TX terminal and the ANT terminal when the switch between the TX terminal and the ANT terminal is turned on improves by about 10% compared to the case illustrated in FIGS. 1 to 17, there is a great advantage of power efficiency improvement in the transmission side. Therefore, the filter 40 having the switch function according to the present embodiment can transmit an RF signal of about 10 W.

Also, though two PIN diodes 45 and 46 are mounted in parallel as illustrated in FIG. 19 according to the above embodiment, the number of diodes to be used can be suitably changed. Also, instead of the ring-shaped substrate 43, a substrate having a different shape such as a U-shape can be used.

Figure 22:
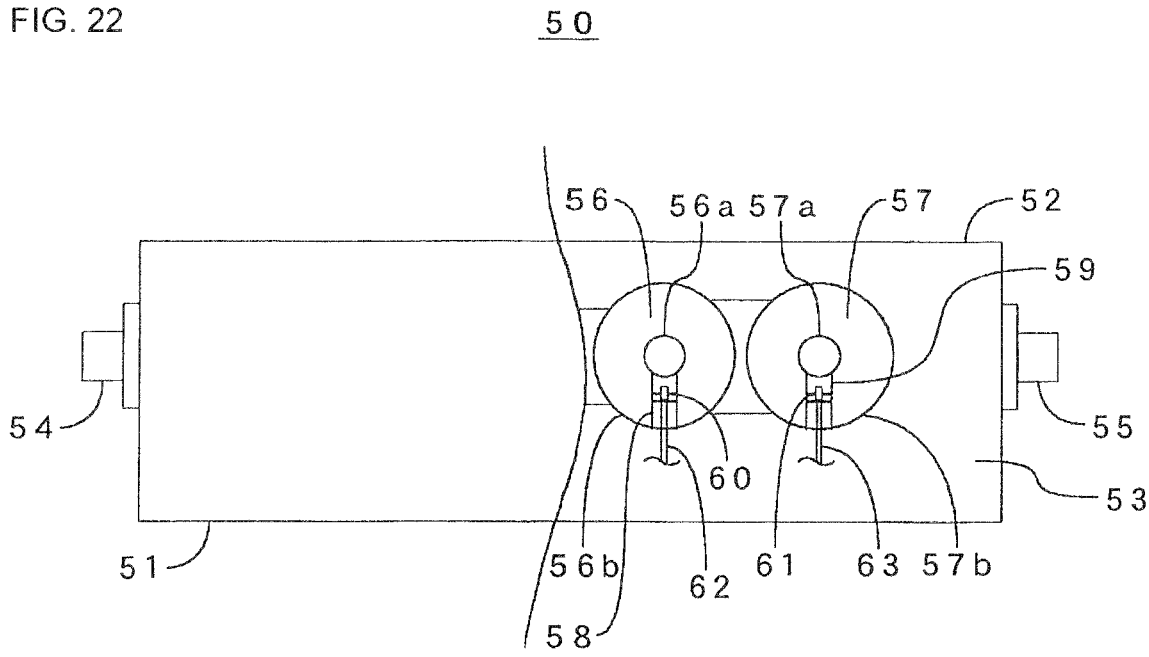
FIG. 22 is a top view illustrating the construction of a band pass filter according to the present invention.

Next, a band pass filter according to the present invention is described with reference to FIGS. 22 and 23.

The band pass filter 50 according to the present embodiment has the almost same basic structure as the portion of the first branch waveguide 6 (refer to FIG. 2B) of the filter 1 having the switch function in FIGS. 1 to 14. This band pass filter 50 has a structure in which a stacked print substrate 53 is inserted between a metal case 51 and a metal cover 52. RF input/output terminals 54 and 55 are installed at both ends of the structure. Also, respective resonators 56 and 57 on a transmission line are configured as semi-coaxial resonators including central conductors 56*a* and 57*a*, and outer conductors 56*b* and 57*b*, respectively. Short-circuiting plates 58 and 59 short-circuiting the neighborhoods of the open end of the central conductors 56*a* and 57*a* and the outer conductors 56*b* and 57*b* are constructed between the central conductors 56*a* and 57*a* and the outer conductors 56*b* and 57*b*. Active devices 60 and 61 such as variable capacitance diodes, and bias lines 62 and 63 for applying a predetermined voltage to them are disposed on the short-circuiting plates 58 and 59.

Figure 23:
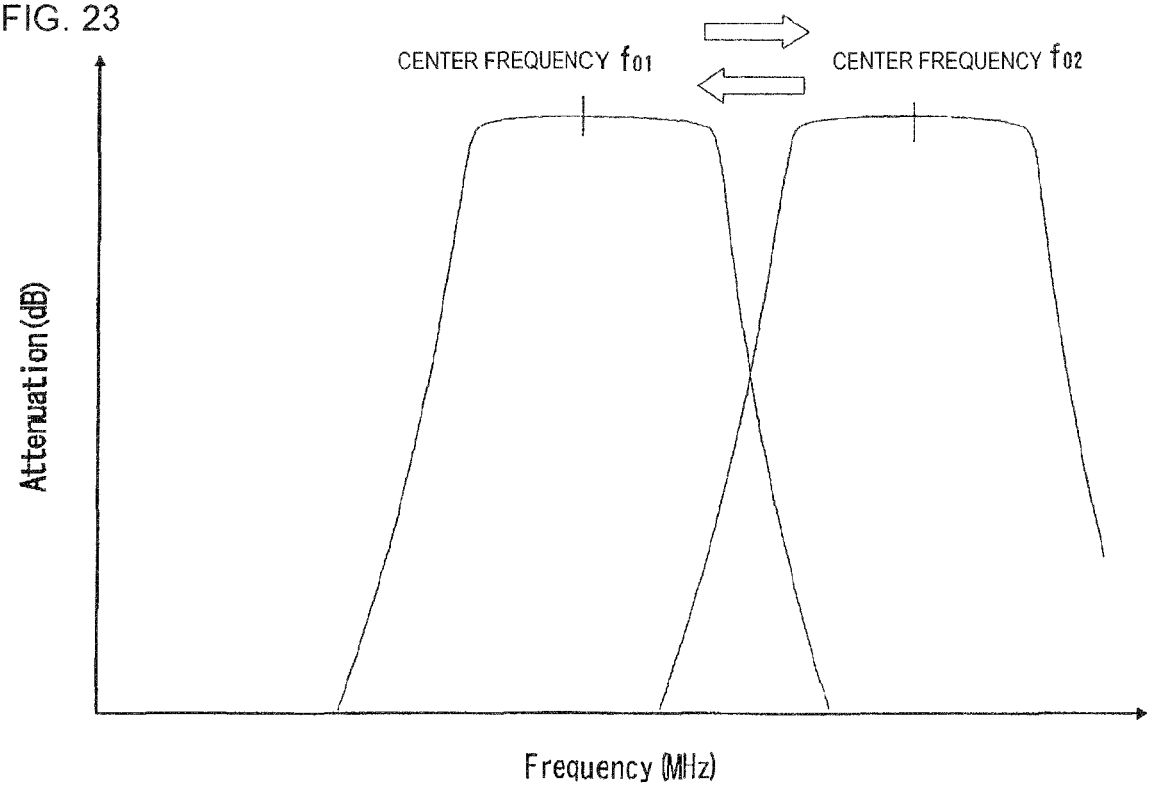
FIG. 23 is a view illustrating an exemplary frequency characteristic in the band pass filter of FIG. 22.
Figure 24:
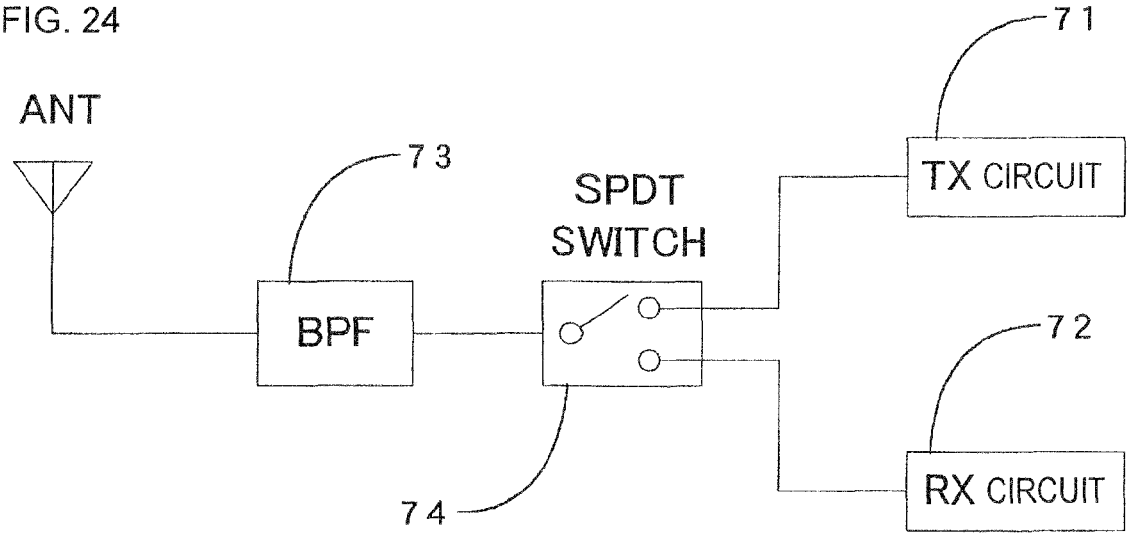
FIG. 24 is a view illustrating the construction of a conventional RF communication device.
Figure 25:
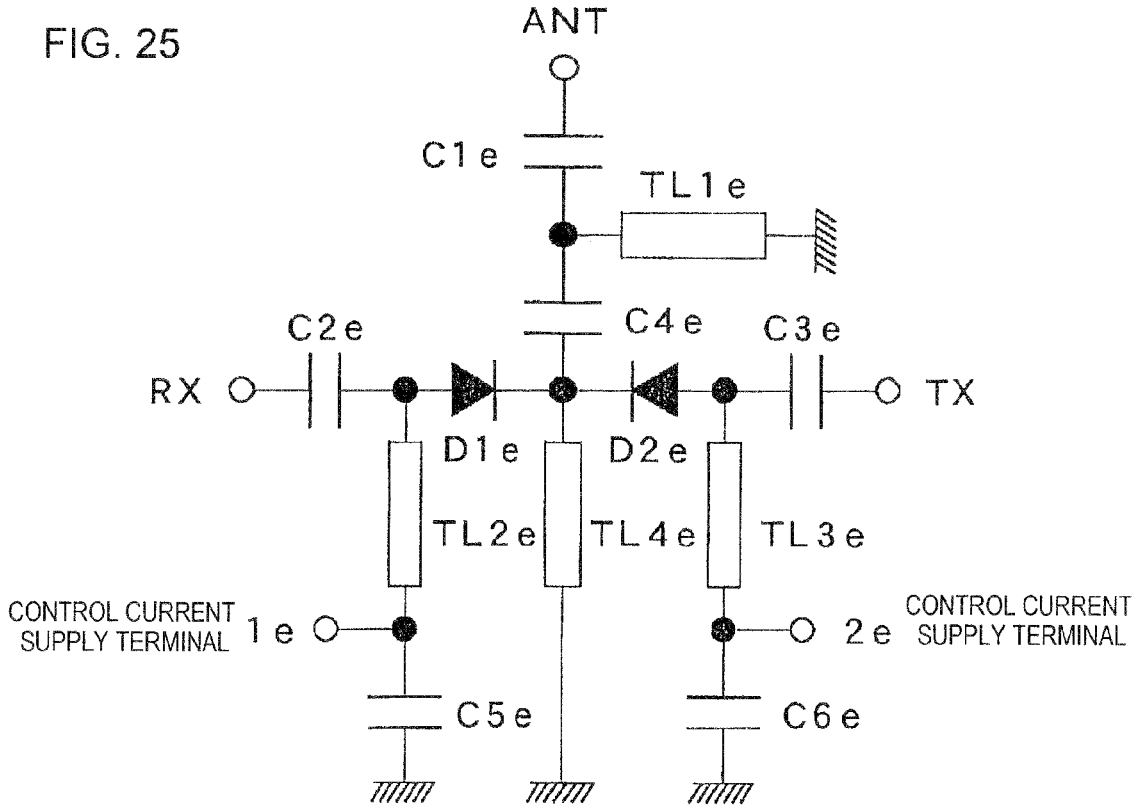
FIG. 25 is an equivalent circuit diagram of a conventional filter having a switch function.

The band pass filter 50 can vary the frequency itself of the filter as illustrated in FIG. 23 by applying a voltage to the active devices 60 and 61 and changing the impedance components of the active devices 60 and 61 using an arbitrary voltage, and thus, realize a frequency variable filter. Also, the short-circuiting plates 58 and 59 do not necessarily need to be provided to all of the resonators on the band pass filter 50. The short-circuiting plates 58 and 59 may be installed only some of the resonators.

It is apparent that the present invention is not limited to the above embodiment, and may be modified and changed without departing from the scope and spirit of the invention.

What is claimed is:

1. A filter having a switch function which comprises:

a waveguide structure having a plurality of resonators inside a metal case; and a plurality of branch waveguides branching from a primary waveguide, said filter selectively transmitting a transmission signal through one of the plurality of branch waveguides, wherein each of said resonators is disposed on said plurality of branch waveguides, each of said resonators including i) an inner conductor which is disposed in a space inside said metal case, one end of said inner conductor being grounded to said metal case, and ii) a short-circuiting portion allowing a neighborhood of an open end of the inner conductor to be selectively conducted to said metal case, wherein electrical conductivity in a region between the neighborhood of the open end of said inner conductor and said metal case is switched between a conductive state and a non-conductive state, so that a selection from said plurality of branch waveguides is performed, and wherein said short-circuiting portion comprises i) a short-circuiting plate connected between the neighborhood of the open end of said inner conductor and said metal case, ii) a short circuit line disposed on the short-circuiting plate to electrically connect the neighborhood of the open end of said inner conductor with said metal case, and iii) an active device disposed on the short circuit line to switch, between said conductive state and said non-conductive state, electrical conductivity in said region between the neighborhood of the open end of said inner conductor and said metal case.

2. The filter as claimed in claim 1, wherein said short-circuiting plate is integrally formed with a stacked print substrate installed between said metal case and a metal cover.

3. The filter as claimed in claim 2, wherein said conductive plate is formed by attaching a conductive coated film on a surface of a dielectric plate integrally formed with said stacked print substrate, and said short-circuiting portion allows said conductive coated film to be selectively conducted to said metal case.

4. The filter according to claim 3, wherein said conductive plate is formed in a ring shape or a U-shape.

5. The filter as claimed in claim 1, wherein said resonator is disposed on at least one of said plurality of branch waveguides, said resonator comprising:

said space inside said metal case;

said inner conductor which is disposed inside said space and said one end of said inner conductor being grounded to said metal case;

a conductive plate disposed inside said space and installed outside an outer peripheral surface of the inner conductor; and said short-circuiting portion allowing said conductive plate to be selectively conducted to said metal case.

6. The filter according to claim 5, wherein said conductive plate is formed in a ring shape or a U-shape.

7. A band pass filter, comprising:

a plurality of resonators inside a metal case, at least one of said plurality of resonators comprising a space inside said metal case, an inner conductor which is disposed inside the space and one end of the inner conductor being grounded to said metal case, and a short-circuiting portion allowing a neighborhood of an open end of the inner conductor to be selectively conducted to said metal case, wherein the resonator changes a frequency characteristic by switching, between a conductive state and a non-conductive state, electrical conductivity in a region between the neighborhood of the open end of said inner conductor and said metal case, and wherein said short-circuiting portion comprises i) a short-circuiting plate connected between the neighborhood of the open end of said inner conductor and said metal case, ii) a short circuit line disposed on the short-circuiting plate to electrically connect the neighborhood of the open end of said inner conductor with said metal case, and iii) an active device disposed on the short circuit line to switch, between said conductive state and said non-conductive state, electrical conductivity in said region between the neighborhood of the open end of said inner conductor and said metal case.

* * * * *